US012404761B2

(12) United States Patent
Brown et al.

(10) Patent No.: US 12,404,761 B2
(45) **Date of Patent: *Sep. 2, 2025**

(54) ELECTRIC SUBMERSIBLE PUMP (ESP) GAS SLUG PROCESSOR AND MITIGATION SYSTEM

(71) Applicant: Halliburton Energy Services, Inc., Houston, TX (US)

(72) Inventors: Donn Jason Brown, Tulsa, OK (US); Ketankumar Kantilal Sheth, Tulsa, OK (US); Casey Laine Newport, Tulsa, OK (US); Trevor Alan Kopecky, Tulsa, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/630,540

(22) Filed: Apr. 9, 2024

(65) Prior Publication Data

US 2024/0254872 A1 Aug. 1, 2024

Related U.S. Application Data

(63) Continuation of application No. 17/369,526, filed on Jul. 7, 2021, now Pat. No. 12,000,258.

(51) Int. Cl.
*E21B 43/38* (2006.01)
*E21B 43/12* (2006.01)

(52) U.S. Cl.
CPC ..... *E21B 43/38* (2013.01); *E21B 43/128* (2013.01)

(58) Field of Classification Search
CPC ..... E21B 43/38; E21B 43/128
See application file for complete search history.

(56) References Cited

U.S. PATENT DOCUMENTS 3,195,661 A 7/1965 Jackson et al.
4,187,912 A 2/1980 Cramer
(Continued)

FOREIGN PATENT DOCUMENTS

CN 106076006 A 11/2016
CN 205965282 U 2/2017
(Continued)

OTHER PUBLICATIONS

Schlumberger Oilfield Glossary entry for "slug flow", accessed Sep. 8, 2023 via glossary.slb.com.
(Continued)

*Primary Examiner* — Blake Michener
(74) *Attorney, Agent, or Firm* — Conley Rose, P.C.; Rodney B. Carroll

(57) ABSTRACT

A downhole gas separator assembly. The gas separator comprises a drive shaft; a first fluid mover mechanically coupled to the drive shaft having a fluid inlet and a fluid outlet; a fluid reservoir concentrically disposed around the drive shaft and located downstream of the first fluid mover, wherein an inside surface of the fluid reservoir and an outside surface of the drive shaft define a first annulus that is fluidically coupled to the fluid outlet of the first fluid mover; a second fluid mover having a fluid inlet and a fluid outlet, wherein the second fluid mover is located downstream of the fluid reservoir, and wherein the fluid inlet of the second fluid mover is fluidically coupled to the first annulus; and a gas flow path and liquid flow path separator having a gas phase discharge port open to an exterior of the assembly and a liquid phase discharge port.

20 Claims, 15 Drawing Sheets

(56) References Cited

U.S. PATENT DOCUMENTS

| | | | |
|---|---|---|---|
| 4,481,020 | A | 11/1984 | Lee et al. |
| 4,901,413 | A | 2/1990 | Cotherman et al. |
| 4,913,630 | A | 4/1990 | Cotherman et al. |
| 5,207,810 | A | 5/1993 | Sheth |
| 5,431,228 | A | 7/1995 | Weingarten et al. |
| 5,525,146 | A | 6/1996 | Straub |
| 6,066,193 | A | 5/2000 | Lee |
| 6,113,675 | A | 9/2000 | Branstetter |
| 6,155,345 | A | 12/2000 | Lee et al. |
| 6,382,317 | B1 | 5/2002 | Cobb |
| 6,412,562 | B1 | 7/2002 | Shaw |
| 6,705,402 | B2 | 3/2004 | Proctor |
| 7,461,692 | B1 | 12/2008 | Wang |
| 7,462,225 | B1 | 12/2008 | Ketter et al. |
| 7,766,081 | B2 | 8/2010 | Brown et al. |
| 8,079,418 | B2 | 12/2011 | Brown et al. |
| 8,955,598 | B2 | 2/2015 | Brown et al. |
| 9,283,497 | B2 | 3/2016 | Wang et al. |
| 10,378,322 | B2 | 8/2019 | Ejim et al. |
| 10,408,035 | B2 | 9/2019 | Kennedy et al. |
| 11,149,535 | B2 | 10/2021 | Brown et al. |
| 11,624,269 | B2 | 4/2023 | Sheth et al. |
| 11,661,828 | B2 | 5/2023 | Conrad et al. |
| 11,867,035 | B2 | 1/2024 | Brown et al. |
| 11,946,472 | B2 | 4/2024 | Sheth et al. |
| 11,965,402 | B2 | 4/2024 | Brown et al. |
| 12,000,258 | B2 * | 6/2024 | Brown ..... E21B 43/38 |
| 12,024,990 | B2 | 7/2024 | Brown et al. |
| 12,060,780 | B2 * | 8/2024 | Sheth ..... E21B 43/128 |
| 2002/0153141 | A1 | 10/2002 | Hartman et al. |
| 2002/0174982 | A1 | 11/2002 | Weingarten |
| 2003/0111230 | A1 | 6/2003 | Olson et al. |
| 2004/0031608 | A1 | 2/2004 | Hall et al. |
| 2009/0044953 | A1 | 2/2009 | Sheth et al. |
| 2009/0065202 | A1 | 3/2009 | Brown et al. |
| 2009/0194295 | A1 | 8/2009 | Thompson et al. |
| 2010/0147514 | A1 | 6/2010 | Swaringin |
| 2010/0319926 | A1 | 12/2010 | Reid |
| 2011/0162832 | A1 | 7/2011 | Reid |
| 2012/0012332 | A1 | 1/2012 | Rooks |
| 2012/0073800 | A1 | 3/2012 | Janitz |
| 2013/0068455 | A1 | 3/2013 | Brown et al. |
| 2014/0174734 | A1 | 6/2014 | Gill et al. |
| 2015/0192141 | A1 | 7/2015 | Nowitzki et al. |
| 2016/0130922 | A1 | 5/2016 | Wilson et al. |
| 2016/0130923 | A1 | 5/2016 | Nowitzki et al. |
| 2016/0201444 | A1 | 7/2016 | Hardee et al. |
| 2016/0222770 | A1 | 8/2016 | Kirk et al. |
| 2016/0312590 | A1 | 10/2016 | Chang et al. |
| 2017/0081952 | A1 | 3/2017 | Osborne et al. |
| 2018/0274344 | A1 | 9/2018 | Ejim et al. |
| 2019/0162063 | A1 * | 5/2019 | Brown ..... F04D 13/10 |
| 2019/0234193 | A1 | 8/2019 | Fehri |
| 2019/0264551 | A1 | 8/2019 | Brown et al. |
| 2019/0316452 | A1 | 10/2019 | Brown et al. |
| 2020/0141223 | A1 | 5/2020 | Brown et al. |
| 2020/0362649 | A1 | 11/2020 | Brown et al. |
| 2022/0065090 | A1 | 3/2022 | Ejim |
| 2023/0010704 | A1 | 1/2023 | Sheth et al. |
| 2023/0014297 | A1 | 1/2023 | Brown et al. |
| 2023/0105823 | A1 | 4/2023 | Brown et al. |
| 2023/0111850 | A1 | 4/2023 | Sheth et al. |
| 2023/0220751 | A1 | 7/2023 | Sheth et al. |
| 2024/0102366 | A1 | 3/2024 | Brown et al. |

FOREIGN PATENT DOCUMENTS

| | | | |
|---|---|---|---|
| WO | 2017053624 | A1 | 3/2017 |
| WO | 2020072078 | A1 | 4/2020 |
| WO | 2021177981 | A1 | 9/2021 |
| WO | 2023282919 | A1 | 1/2023 |
| WO | 2023282920 | A1 | 1/2023 |
| WO | 2023215027 | A1 | 11/2023 |
| WO | 2024072509 | A1 | 4/2024 |
| WO | 2024072510 | A1 | 4/2024 |

OTHER PUBLICATIONS

Electronic Acknowledgment Receipt, Specification and Drawings for International Application No. PCT/US2021/042389, entitled "Integrated Gas Separator and Pump," filed Jul. 20, 2021, 50 pages.

Electronic Acknowledgment Receipt, Specification and Drawings for International Application No. PCT/US2021/042395, entitled "Electric Submersible Pump (ESP) Gas Slug Processor and Mitigation System," filed Jul. 20, 2021, 51 pages.

Foreign Communication from Related Application—International Search Report and Written Opinion of the International Searching Authority, International Application No. PCT/US2020/022038, dated Nov. 27, 2020, 13 pages.

Foreign Communication from Related Application—International Search Report and Written Opinion of the International Searching Authority, International Application No. PCT/US2021/042395, dated Mar. 25, 2022, 14 pages.

Foreign Communication from Related Application—International Search Report and Written Opinion of the International Searching Authority, International Application No. PCT/US2021/042389, dated Apr. 4, 2022, 11 pages.

Foreign Communication from Related Application—International Search Report and Written Opinion of the International Searching Authority, International Application No. PCT/US2023/013758, dated Jun. 9, 2023, 10 pages.

Filing Receipt, Specification and Drawings for U.S. Appl. No. 17/954,855, filed Sep. 28, 2022, entitled "Electric Submersible Pump (ESP) Assembly Fluid Intake Extension," 61 pages.

Foreign Communication from Related Application—International Search Report and Written Opinion of the International Searching Authority, International Application No. PCT/US2023/025736, dated Oct. 17, 2023, 11 pages.

Foreign Communication from Related Application—International Search Report and Written Opinion of the International Searching Authority, International Application No. PCT/US2023/025717, dated Oct. 12, 2023, 12 pages.

First Office Action dated Apr. 15, 2024 (28 pages), U.S. Appl. No. 17/954,855, filed Sep. 28, 2022.

Filing Receipt, Specification and Drawings for U.S. Appl. No. 18/610,817, entitled "Electric Submersible Pump (ESP) Shroud System," filed Mar. 20, 2024 49 pages.

* cited by examiner

ELECTRIC SUBMERSIBLE PUMP (ESP) GAS SLUG PROCESSOR AND MITIGATION SYSTEM

CROSS-REFERENCE TO RELATED APPLICATIONS

The present application is a continuation of and claims priority to U.S. patent application Ser. No. 17/369,526 filed Jul. 7, 2021, entitled "Electric Submersible Pump (ESP) Gas Slug Processor and Mitigation System," which is hereby incorporated by reference in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Electric submersible pumps (hereafter "ESP" or "ESPs") may be used to lift production fluid in a wellbore. Specifically, ESPs may be used to pump the production fluid to the surface in wells with low reservoir pressure. ESPs may be of importance in wells having low bottomhole pressure or for use with production fluids having a low gas/oil ratio, a low bubble point, a high water cut, and/or a low API gravity. Moreover, ESPs may also be used in any production operation to increase the flow rate of the production fluid to a target flow rate.

Generally, an ESP comprises an electric motor, a seal section, a pump intake, and one or more pumps (e.g., a centrifugal pump). These components may all be connected with a series of shafts. For example, the pump shaft may be coupled to the motor shaft through the intake and seal shafts. An electric power cable provides electric power to the electric motor from the surface. The electric motor supplies mechanical torque to the shafts, which provide mechanical power to the pump. Fluids, for example reservoir fluids, may enter the wellbore where they may flow past the outside of the motor to the pump intake. These fluids may then be produced by being pumped to the surface inside the production tubing via the pump, which discharges the reservoir fluids into the production tubing.

The reservoir fluids that enter the ESP may sometimes comprise a gas fraction. These gases may flow upwards through the liquid portion of the reservoir fluid in the pump. The gases may even separate from the other fluids when the pump is in operation. If a large volume of gas enters the ESP, or if a sufficient volume of gas accumulates on the suction side of the ESP, the gas may interfere with ESP operation and potentially prevent the intake of the reservoir fluid. This phenomenon is sometimes referred to as a "gas lock" because the ESP may not be able to operate properly due to the accumulation of gas within the ESP.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
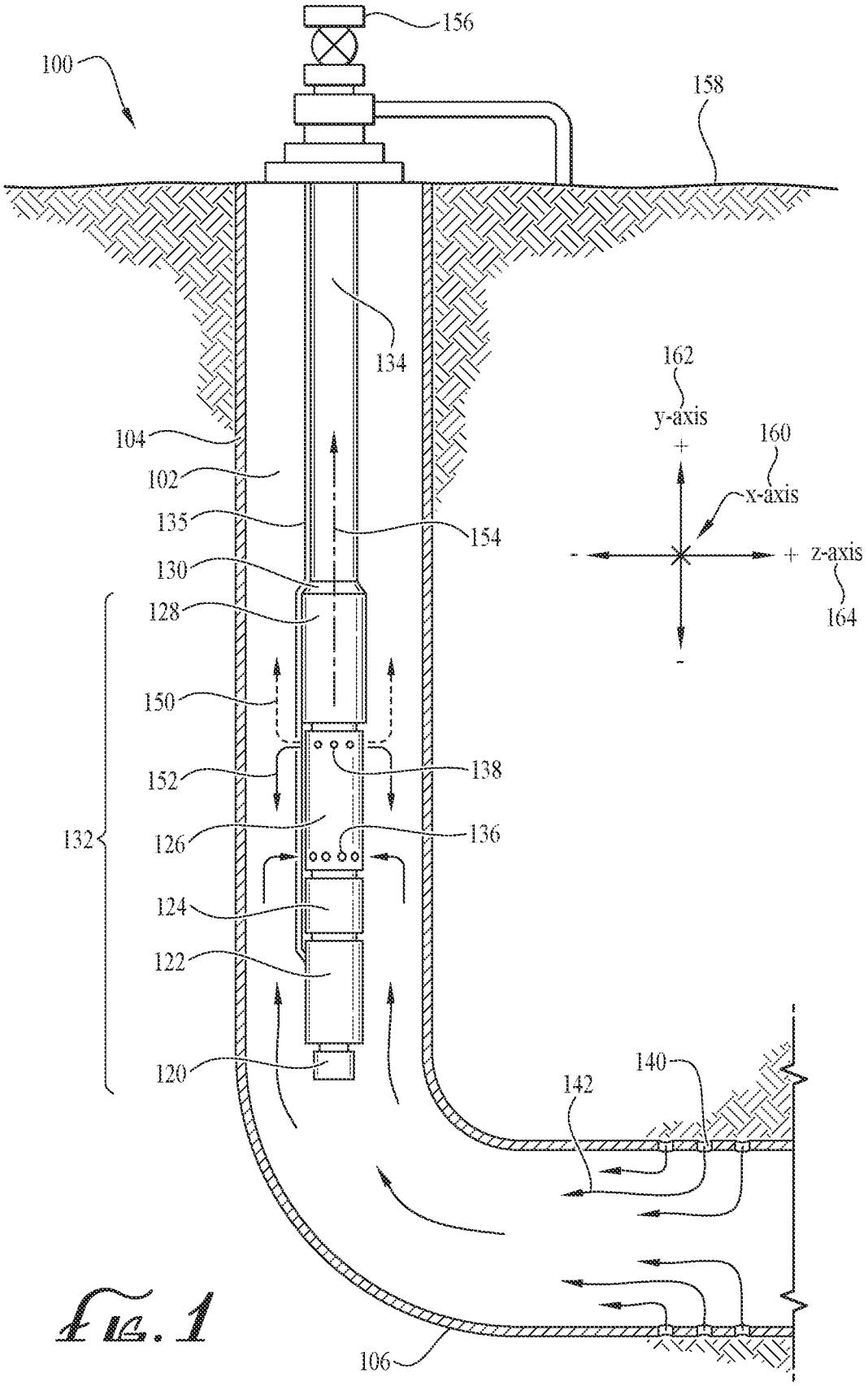
FIG. 1 is an illustration of an electric submersible pump (ESP) assembly according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

As used herein, orientation terms "upstream," "downstream," "up," "down," "uphole," and "downhole" are defined relative to the direction of flow of well fluid in the well casing. "Upstream" is directed counter to the direction of flow of well fluid, towards the source of well fluid (e.g., towards perforations in well casing through which hydrocarbons flow out of a subterranean formation and into the casing). "Downstream" is directed in the direction of flow of well fluid, away from the source of well fluid. "Down" and "downhole" are directed counter to the direction of flow of well fluid, towards the source of well fluid. "Up" and "uphole" are directed in the direction of flow of well fluid, away from the source of well fluid. "Fluidically coupled" means that two or more components have communicating internal passageways through which fluid, if present, can flow. A first component and a second component may be "fluidically coupled" via a third component located between the first component and the second component if the first component has internal passageway(s) that communicates with internal passageway(s) of the third component, and if the same internal passageway(s) of the third component communicates with internal passageway(s) of the second component.

Gas entering a centrifugal pump of an electric submersible pump (ESP) assembly can cause various difficulties for a centrifugal pump. In an extreme case, the pump may become gas locked and become unable to pump fluid. In less extreme cases, the pump may experience harmful operating conditions when transiently passing a slug of gas. When in operation, the centrifugal pump rotates at a high rate of speed (e.g., about 3600 RPM) and relies on the continuous flow of reservoir liquid to both cool and lubricate its bearing surfaces. When this continuous flow of reservoir liquid is interrupted, even for a brief period of seconds, the bearings of the centrifugal pump may heat up rapidly and undergo significant wear, shortening the operational life of the centrifugal pump, thereby increasing operating costs due to more frequent change-out and/or repair of the centrifugal pump. Down time involved in repairing or replacing the centrifugal pump may also interrupt well production undesirably. In some operating environments, for example in some horizontal wellbores, gas slugs that persist for at least 10 seconds are repeatedly experienced. Some gas slugs may persist for as much as 30 seconds or more. The present disclosure teaches a new gas separator assembly that mitigates the effects of gas slugs.

A gas separator assembly may comprise an inlet that feeds reservoir fluid to a first fluid mover (e.g., a multi-stage centrifugal pump or a rotating auger), and the first fluid mover drives reservoir fluid through to a second fluid mover, and the second fluid mover (e.g., a paddle wheel, a stationary auger, a vortex inducer) imparts a rotating motion to the reservoir fluid. The rotating reservoir fluid flows from the second fluid mover into a separation chamber. The rotation of the reservoir fluid in the separation chamber tends to separate gas phase fluid from liquid phase fluid. Due to the rotation of the reservoir fluid, the relatively lower density gas phase fluid tends to concentrate near a centerline axis of the gas separator assembly (e.g., near a drive shaft of the gas separator assembly), and the relatively higher density liquid phase fluid tends to concentrate near an inside wall of a housing or separation chamber of the gas separator assembly. The fluid near the centerline axis enters a gas phase discharge of the gas separator assembly and exits the gas separator assembly to an annulus formed between the wellbore and the outside of the ESP assembly; the fluid near the inside wall enters a liquid phase discharge of the gas separator assembly and is directed downstream to another stage of the gas separator assembly or to an inlet of the centrifugal pump assembly. In this way the reservoir fluid that is fed downstream to the inlet of the centrifugal pump assembly may be said to be a liquid enriched reservoir fluid or a liquid enriched fraction of the reservoir fluid.

In the circumstance of a large slug of gas reaching the ESP assembly, however, a conventional gas separator assembly may quickly fill with gas. In this circumstance, there is no liquid phase fraction to separate and forward on as a liquid enriched fraction of the reservoir fluid. When the large slug of gas first reaches the gas separator assembly, for a short period of time, liquid phase fluid retained within the passageways of the fluid mover may mix with the gas of the slug, and a blend of gas phase fluid and liquid phase fluid may be supplied briefly by the gas separator assembly to the centrifugal pump assembly. This blend of gas phase fluid and liquid phase fluid may provide lubrication to bearing surfaces of the centrifugal pump assembly, provide heat transfer away from bearing surfaces of the centrifugal pump assembly, and avoid putting the centrifugal pump assembly into a gas lock condition. But the passageways of the fluid mover (e.g., vane channels of impellers and diffusers) are limited in volume, and the retained liquid phase fluid is rapidly depleted in the presence of a large gas slug. The present disclosure teaches creating additional internal volumes inside the gas separator assembly between fluid mover stages (e.g., between centrifugal pump stages) that operate as reservoirs of liquid phase fluid that can extend the transition time from normal operation to a condition in which the gas separator assembly is completely gas filled and supplies no liquid phase fluid to the inlet of the centrifugal pump assembly.

Turning now to FIG. 1 a well site environment 100, according to one or more aspects of the disclosure, is described. The well site environment 100 comprises a wellbore 102 that is at least partially cased with casing 104. As depicted in FIG. 1, the wellbore 102 has a deviated or horizontal portion 106, but the electric submersible pump (ESP) assembly 132 described herein may be used in a wellbore 102 that does not have a deviated or horizontal portion 106. The well site environment 100 may be at an on-shore location or at an off-shore location. The ESP assembly 132 in an embodiment comprises a sensor package 120, an electric motor 122, a seal unit 124, a gas separator assembly 126, and a centrifugal pump assembly 128. The centrifugal pump assembly may couple to a production tubing 134 via a connector 130. An electric cable 135 may attach to the electric motor 122 and extend to the surface 158 to connect to an electric power source. The gas separator assembly 126 comprises inlet ports 136 and gas phase discharge ports 138. The casing 104 and/or wellbore 102 may have perforations 140 that allow reservoir fluid 142 to pass from the subterranean formation through the perforations 140 and into the wellbore 102. In an embodiment, a distance between the inlet ports 136 and the gas discharge ports 138 are less than 500 feet and at least 4 feet, at least 6 feet, at least 8 feet, at least 10 feet, at least 12 feet, at least 14 feet, at least 16 feet, at least 18 feet, at least 20 feet, at least 22 feet, at least 24 feet, at least 26 feet, at least 28 feet, at least 30 feet, at least 32 feet, at least 35 feet, at least 40 feet, at least 45 feet, at least 50 feet, at least 60 feet, at least 70 feet, at least 80 feet, at least 90 feet, at least 100 feet, at least 120 feet, or at least 140 feet.

The reservoir fluid 142 may flow uphole towards the ESP assembly 132 and into the inlet ports 136. The reservoir fluid 142 may comprise a liquid phase fluid. The reservoir fluid 142 may comprise a gas phase fluid mixed with a liquid phase fluid. The reservoir fluid 142 may comprise only a gas phase fluid (e.g., simply gas). Over time, the gas to fluid ratio of the reservoir fluid 142 may change dramatically. For example, in the horizontal portion 106 of the wellbore gas may build up in high points in the roof of the wellbore 102 and after accumulating sufficiently may "burp" out of these high points and flow downstream to the ESP assembly 132 as what is commonly referred to as a gas slug. Thus, immediately before a gas slug arrives at the ESP assembly 132, the gas fluid ratio of the reservoir fluid 142 may be very low (e.g., the reservoir fluid 142 at the ESP assembly 132 is mostly liquid phase fluid); when the gas slug arrives at the ESP assembly 132, the gas fluid ratio is very high (e.g., the reservoir fluid 142 at the ESP assembly 132 is entirely or almost entirely gas phase fluid); and after the gas slug has passed the ESP assembly 132, the gas fluid ratio may again be very low (e.g., the reservoir fluid 142 at the ESP assembly 132 is mostly liquid phase fluid).

Under normal operating conditions (e.g., reservoir fluid 142 is flowing out of the perforations 140, the ESP assembly 132 is energized by electric power, the electric motor 122 is turning, and a gas slug is not present at the ESP assembly 132), the reservoir fluid 142 enters the inlets 136, the reservoir fluid 142 is separated by the gas separator assembly 138 into a gas phase fluid (or a mixed-phase fluid having a higher gas liquid ratio than the reservoir fluid 142 entering the inlet ports 136) and a liquid phase fluid (or a mixed-phase fluid having a lower gas liquid ratio than the reservoir fluid 142 entering the inlet ports 136). The gas phase fluid is discharged via the gas phase discharge ports 138, and the liquid phase fluid is flowed downstream to the centrifugal pump assembly 128 as liquid phase fluid 154. Under normal operating conditions, the gas phase fluid that is discharged into the annulus between the casing 104 and the outside of the ESP assembly 132 may comprise both gas phase fluid 150 that rises uphole in the wellbore 102 and liquid phase fluid 152 that falls downhole in the wellbore 102. The centrifugal pump assembly 128 flows the liquid phase fluid 154 (e.g., a portion of the reservoir fluid 142) up the production tubing 134 to a wellhead 156 at the surface 158.

An orientation of the wellbore 102 and the ESP assembly 132 is illustrated in FIG. 1 by an x-axis 160, a y-axis 162, and a z-axis 164. In an embodiment, the centrifugal pump assembly 128 comprises one or more centrifugal pump stages, where each stage comprises an impeller that is mechanically coupled to a drive shaft within the centrifugal pump assembly 128 and a corresponding diffuser that is stationary and retained by a housing of the centrifugal pump assembly 128. In an embodiment, the impellers may comprise a keyway that mates with a corresponding keyway on the drive shaft of the centrifugal pump assembly 128 and a key may be installed into the two keyways, wherein the impeller may be mechanically coupled to the drive shaft of the centrifugal pump assembly.

Turning now to FIG. 2A, FIG. 2B, FIG. 2C, and FIG. 2D, further details of the gas separator assembly 126 are described. The gas separator assembly 126 comprises a base 403, a housing 312, a crossover 350, and a head 355. The base 410 has the inlet ports 136 and couples threadingly at a downstream end with an upstream end of the housing 312, for example via threaded coupling 403. In some contexts, the base 410 may be said to be mechanically coupled to the housing 312. In an embodiment, the base 410 couples to the seal unit 124, for example with a bolted connection (not shown) or a threaded coupling. The housing 312 may be a cylindrical hollow metal pipe. In an embodiment, an inside of the housing 312 may be machined or drilled at one or more locations to create slots or shallow holes for fixing and retaining components within the housing 312, for example diffusers or other components.

Figure 2A:
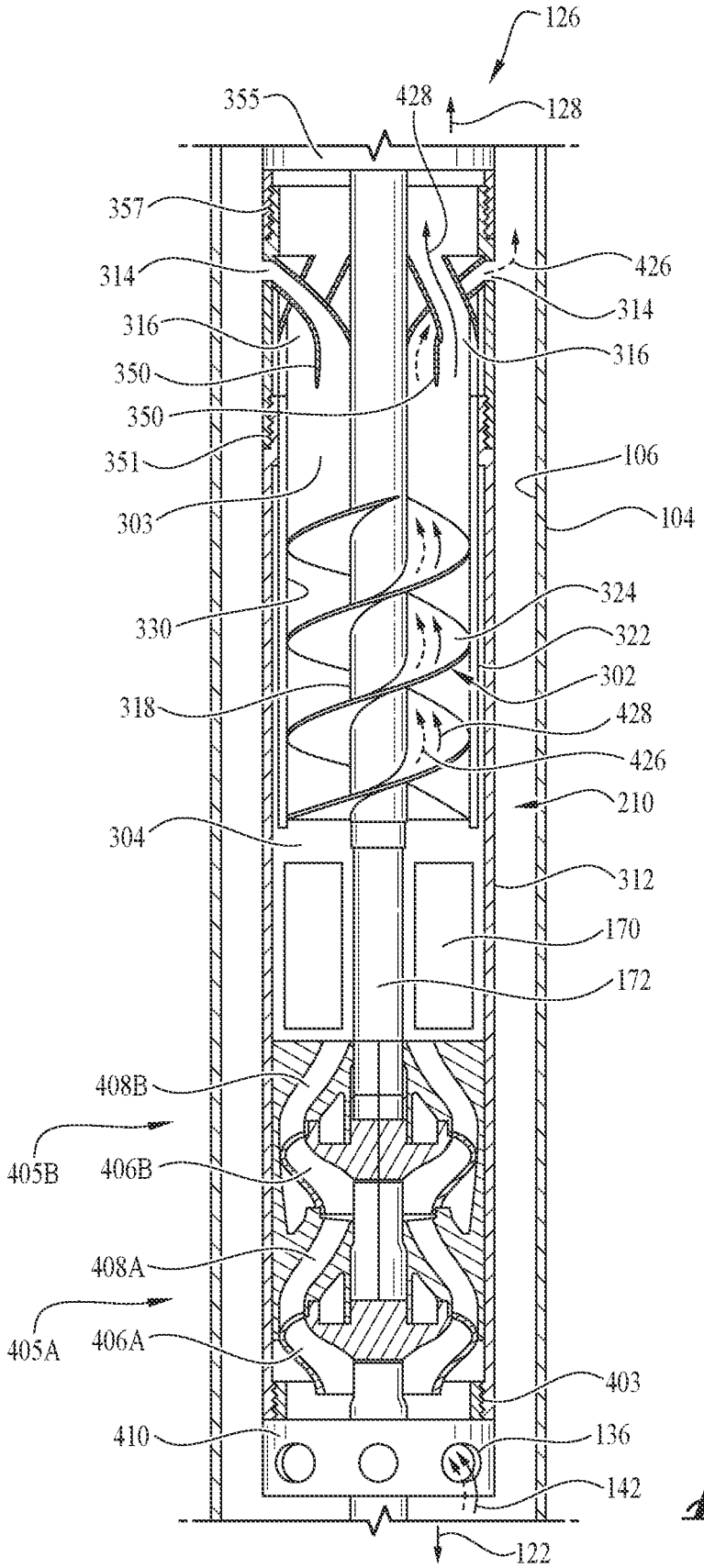
FIG. 2A, FIG. 2B, FIG. 2C, and FIG. 2D are an illustration of a gas separator assembly according to embodiments of the disclosure.
Figure 2B:
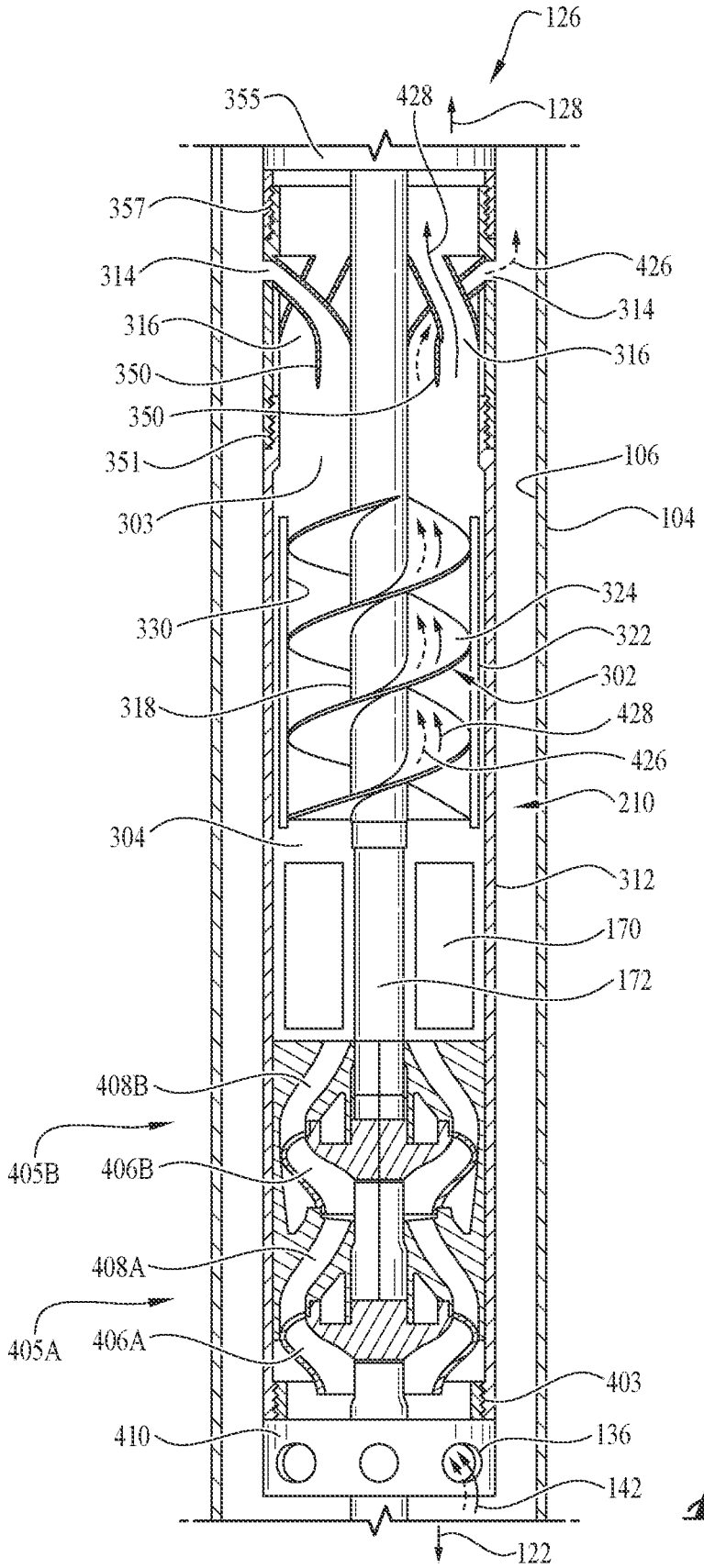
Figure 2C:
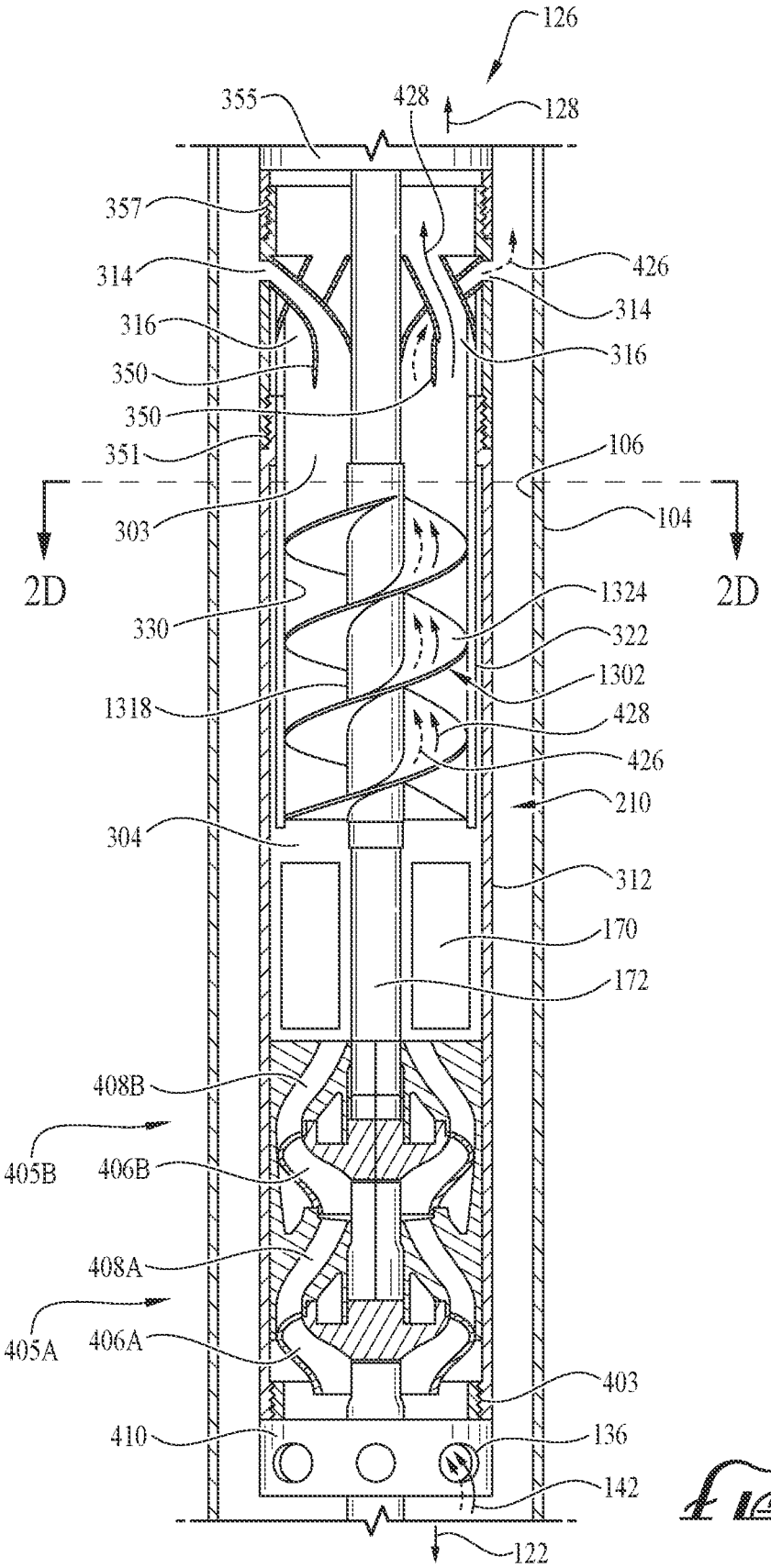
Figure 2D:
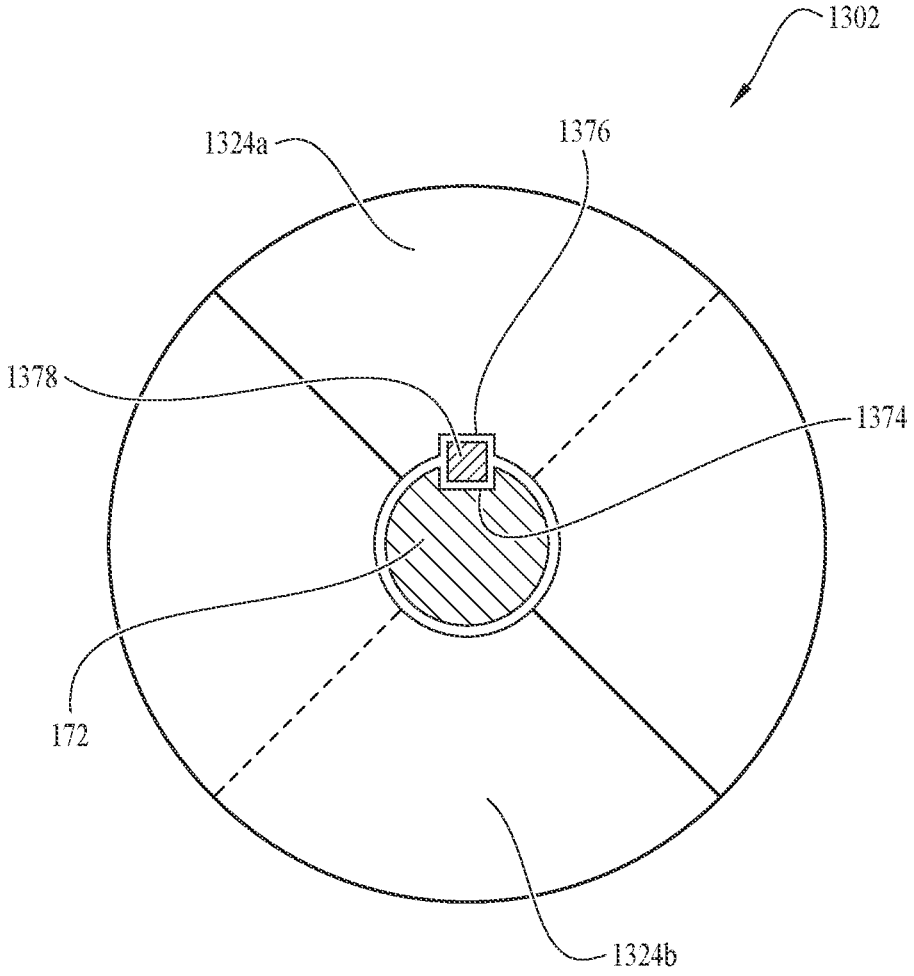

In an embodiment, the housing 312 encloses a plurality of centrifugal pump stages 405, for example a first centrifugal pump stage 405A and a second centrifugal pump stage 405B. Each centrifugal pump stage 405 comprises an impeller 406 mechanically coupled to a drive shaft 172 of the gas separator assembly 126 and a diffuser 408 that is retained and held stationary by the housing 312. In an embodiment, the impeller 406 may have a keyway that mates with a keyway in the drive shaft 172 and the keyway of the impeller 406 may be secured to the keyway in the drive shaft 172 by a key. In an embodiment, the impeller 406 may be mechanically coupled to the drive shaft 172 in a different way. When the drive shaft 172 turns, the impeller 406 turns. The first centrifugal pump stage 405A comprises a first impeller 406A and a first diffuser 408A; the second centrifugal pump stage 405B comprises a second impeller 406B and a second diffuser 408B. While two centrifugal pump stages 405A and 405B are illustrated in FIG. 2A, FIG. 2B, and FIG. 2C, in another embodiment, there may be a single centrifugal pump stage 405, three centrifugal pump stages 405, four centrifugal pump stages 405, five centrifugal pump stages 405, six centrifugal pump stages 405, or more centrifugal pump stages 405 located between the base 410 and the fluid reservoir 170. The centrifugal pump stages 405 may be referred to as a first fluid mover in some contexts. In an embodiment, the centrifugal pump stages 405 of the gas separator assembly 126 are replaced by another fluid mover mechanism, for example replaced by an auger mechanically coupled to the drive shaft 172 (as illustrated in FIG. 2C and FIG. 2D), one or more impeller mechanically coupled to the drive shaft 172 (e.g., without a corresponding diffuser), and/or a paddle wheel mechanically coupled to the drive shaft 172. The auger mechanically coupled to the drive shaft 172 may be referred to as a rotating auger 1302 and may comprise one or more vanes 1324 and a shaft 1318 that encloses the drive shaft 172. The rotating auger 1302 may define a keyway 1376 in its inside that may be aligned with a keyway 1374 defined in an outside of the drive shaft 172. A key 1378 may be inserted into the keyways 1374, 1376 to mechanically couple the rotating auger 1302 to the drive shaft 172. As shown in FIG. 2D, the rotating auger 1302 may have a first vane 1324*a* and a second vane 1324*b*.

In an embodiment, the drive shaft 172 is mechanically coupled to a drive shaft of the seal unit 124, and the drive shaft of the seal unit 124 is mechanically coupled to a drive shaft of the electric motor 122. Thus, the drive shaft 172 and the impellers 406 (e.g., impellers 406A and 406B in FIG. 2A, FIG. 2B, and FIG. 2C) of the one or more centrifugal pump stages 405 are turned indirectly by the electric motor 122 when it is energized by electric power via the electric cable 135. The drive shaft 172 is mechanically coupled to a drive shaft of the centrifugal pump assembly 128 and transfers rotational power to the drive shaft of the centrifugal pump assembly 136 and to impellers of the centrifugal pump stages of the centrifugal pump assembly 136. The several different drive shaft mechanical couplings may be provided by splines cut in the mating ends of shafts and coupled by a spline coupler or hub. In another embodiment, the drive shaft mechanical couplings may be provided by other devices.

The housing 312 also encloses a fluid reservoir 170. In an embodiment, the fluid reservoir 170 is formed as an annulus between the outside of the drive shaft 172 and the interior wall of the housing 312. In an embodiment (as illustrated in FIG. 2 B), the fluid reservoir 170 is formed by a sleeve retained within the housing 312 that has an inlet at an upstream end of the fluid reservoir 170 that is fluidically coupled to an outlet of the second diffuser 408A and has an outlet 304 at a downstream end of the fluid reservoir 170 that is fluidically coupled to an upstream end of a second fluid mover, for example a stationary auger 302. The fluid reservoir 170 may retain mostly liquid phase fluid when the ESP assembly 132 is experiencing normal operating conditions (e.g., when the electric motor 122 is energized and turning, when reservoir fluid 142 is entering the wellbore 102 and flowing in the inlet ports 136, and in the absence of a gas slug), and this liquid phase fluid can be mixed progressively with gas when the ESP assembly 132 receives a gas slug to extend the time that the gas separator assembly 126 is able to continue to supply at least some liquid phase fluid to the centrifugal pump assembly 128.

For example, at a first point in time, before the gas slug arrives at the inlet ports 136, the outlet 304 of the fluid reservoir 170 may provide fluid having a first gas liquid ratio (GLR) to the stationary auger 302. As gas from the gas slug enters the inlet ports 136, at a second point in time (after the first point in time) the gas mixes with the fluid in the fluid reservoir 170, and the outlet 304 of the fluid reservoir 170 may provide fluid having a second GLR to the stationary auger 302, where the second GLR is greater than the first GLR. At a third point in time (after the second point in time) the gas continues to mix with the fluid in the fluid reservoir 170, and the outlet 304 of the fluid reservoir 170 may provide fluid having a third GLR to the stationary auger 302, where the third GLR is greater than the second GLR. At a fourth point in time (after the third point in time), when the gas slug passes the ESP assembly 132 and is no longer be drawn into the inlet ports 136, the reservoir fluid 142 entering the inlet ports 136 may again be primarily liquid phase fluid, and the outlet 304 of the fluid reservoir 170 may provide fluid having a fourth GLR to the stationary auger 302, where the fourth GLR is less than the third GLR. At a fifth point in time (after the fourth point in time), the outlet 304 of the fluid reservoir 170 may provide fluid having a fifth GLR to the stationary auger 302, where the fifth GLR is less than the fourth GLR and approximately equal to the first GLR. It is noted that without the primarily liquid phase fluid retained in the fluid reservoir 170 at the time that the gas slug arrived at the ESP assembly 132 and the inlet ports 136, the GLR would have risen very quickly and would have flowed gas unmixed from the outlets of the second diffuser 408B to the auger 302, from the stationary auger 302 to the separation chamber 303, from the separation chamber 303 to the liquid phase discharge 316 of the crossover 350, and from the liquid phase discharge 316 to the inlet of the centrifugal pump assembly 128, with the undesirable effect that the bearings of the centrifugal pump assembly 128 would lose lubrication, would rapidly heat up, would rapidly degrade, and likely would leave the centrifugal pump stages in the centrifugal pump assembly 128 in a gas lock situation. In an embodiment, the gas separator assembly 126 may also have one or more centrifugal pump stages between the fluid reservoir 170 and the stationary auger 302.

The housing 312 also encloses a stationary auger 302. In one or more embodiments, the stationary auger 302 is disposed or positioned within a sleeve 322. The centrifugal pump stages 405 communicates or forces reservoir fluid 142 received at the one or more inlet ports 136 through the fluid reservoir 170 and through the stationary auger 302. In an embodiment, an outside edge of the stationary auger 302 engages sealingly with an inside surface 330 of the sleeve 322, and the flow of reservoir fluid 142 through the sleeve 322 is hence confined to the passageway or passageways defined by the stationary auger 302. The sleeve 322 may be disposed or positioned within and retained by the housing 312. In an embodiment, the stationary auger 302 and the sleeve 322 may be built or manufactured as a single component.

In an embodiment, there is no sleeve 322 and the stationary auger 302 is disposed within the inside of the housing 312. The stationary auger 202 may be retained by the inside of the housing 312. In an embodiment, the stationary auger 302 engages sealingly with an inside surface of the housing 312. In an embodiment, there is a space between the outside edges of the stationary auger 302 and the inside surface 330 of the sleeve 332 or a space between the outside edges of the stationary auger 302 and the inside surface of the housing 312.

In one or more embodiments, the stationary auger 302 comprises one or more helixes or vanes 324. In one or more embodiments, the helixes or vanes 324 may be crescent-shaped. In one or more embodiments, the stationary auger 302 comprises one or more helixes or vanes 324 disposed about a solid core, for example shaft 318 that encloses the drive shaft 172, or an open core (for example, a coreless auger or an auger flighting). The stationary auger 302 may cause the reservoir fluid 142 to be separated into a liquid phase fluid 428 and gas phase fluid 426 based, at least in part, on rotational flow of the reservoir fluid 142.

For example, the one or more helixes or vanes 324 may impart rotation to the reservoir fluid 142 as the reservoir fluid 142 flows through, across or about the one or more helixes or vanes 324. The stationary auger 302, then, can be referred to as a fluid mover at least because it imparts a rotating motion to the reservoir fluid 142 as the reservoir fluid 142 flows through the stationary auger 302. For example, fluid mover 310 forces the reservoir fluid 142 at a velocity or flow rate into the sleeve 322 and up or across the one or more helixes or vanes 324 of stationary auger 302. The rotation of the reservoir fluid 142 induced by the stationary auger 302 may be based, at least in part, on the velocity or flow rate of the reservoir fluid 142 generated by the centrifugal pump stages 405. For example, the centrifugal pump stages 405 may increase the flow rate or velocity of the reservoir fluid 142 to increase rotation of the reservoir fluid 142 through the stationary auger 302 to create a more efficient and effective separation of the reservoir fluid 142 into a plurality of phases, for example, a liquid phase fluid 428 and a gas phase fluid 426. As the reservoir fluid 142 flows through the stationary auger 302, centrifugal forces, static friction or both, cause the heavier component of the reservoir fluid 142, a liquid phase fluid 428, to circulate along an outer perimeter of the stationary auger 112 while the lighter component of the reservoir fluid 142, the gas phase fluid 426, is circulated along an inner perimeter of the stationary auger 302. In one or more embodiments, reservoir fluid 142 may begin to separate while flowing through stationary auger 302. In one or more embodiments, the liquid phase fluid 428 may comprise residual gas that did not separate into the gas phase fluid 426. However, the embodiments discussed herein reduce this residual gas to protect the centrifugal pump assembly 128 from gas build-up or gas lock.

In an embodiment, the stationary auger 302 is not present and instead a different kind of second fluid mover is provided. The second fluid mover may be provided by an auger mechanically coupled to the drive shaft 172, a paddle wheel mechanically coupled to the drive shaft 172, a centrifuge rotor mechanically coupled to the drive shaft 172, or an impeller mechanically coupled to the drive shaft 172 that induce rotating motion of the reservoir fluid 142. In an embodiment, a third fluid mover is provided downstream of the stationary auger 302, for example a paddle wheel may be installed downstream of the stationary auger 172 that induces and/or increases rotating motion of the reservoir fluid 142.

A separation chamber 303 is provided downstream of the second fluid mover (e.g., the stationary auger 302) and downstream of the optional third fluid mover. An upstream end of the separation chamber 303 is fluidically coupled to a downstream end or an outlet of the stationary auger 302 or other second fluid mover. Alternatively, the upstream end of the separation chamber 303 is fluidically coupled to a downstream end or an outlet of the optional third fluid mover and is fluidically coupled to the third fluid mover and, via the third fluid mover, fluidically coupled to the second fluid mover. The separation chamber 303 is defined by an annulus formed between the inside of the housing 312 and the outside of the drive shaft 172. In an embodiment, the separation chamber 303 is less than 36 inches long and at least 4 inches long, at least 6 inches long, at least 8 inches long, at least 10 inches long, at least 12 inches long, or at least 14 inches long. In an embodiment, the separation chamber is at least 6 inches long and less than 17 inches long. The stationary auger 302 (or other second fluid mover and/or third fluid mover) induces a rotating motion in the reservoir fluid 142. As the reservoir fluid 142 exits the stationary auger 302 (or other second fluid mover and/or third fluid mover) and enters the separation chamber 303, this rotating motion of the reservoir fluid 142 continues. The rotating motion of the reservoir fluid 142 within the separation chamber 303 induces gas phase fluid (which is less dense than the liquid phase fluid) to concentrate near the drive shaft 172 and the liquid phase fluid to concentrate near the inside surface of the housing 312.

In one or more embodiments, the separated fluids (for example, liquid phase fluid 428 and gas phase fluid 426) are directed to a crossover 350. For example, the crossover 350 may be disposed or positioned at a downstream end of the separation chamber 303 or housing 312. In some contexts, the crossover 350 may be referred to as a gas flow path and liquid flow path separator. The crossover 350 may comprise a plurality of channels or define a plurality of channels, for example, a gas phase discharge 314 (a first pathway) and a liquid phase discharge 316 (a second pathway). A gas phase fluid 426 of the reservoir fluid 142 may be discharged through the gas phase discharge 314, out the gas phase discharge ports 138, and a liquid phase fluid 428 of the reservoir fluid 142 may be discharged through the liquid phase discharge 316. In one or more embodiments, gas phase discharge 314 may correspond to any one or more discharge ports 138 of FIG. 1. In one or more embodiments, any one or more of the gas phase discharge ports 314 and the one or more liquid phase discharge ports 316 may be defined by a channel or pathway having an opening, for example, a teardrop shaped opening, a round opening, an elliptical opening, a triangular opening, a square opening, or another shaped opening. The crossover 350 may be threadingly coupled at an upstream end by threaded coupling 351 to a downstream end of the housing 312. The crossover 350 may be threadingly coupled at a downstream end by threaded coupling 357 to a head 355. Alternatively, the head 355 may be integrated with the head 355 rather than threadingly coupled to the head 355. The head 355 may provide bolt holes for coupling to an upstream end of the centrifugal pump assembly 128. In some contexts, the crossover 350 may be said to be mechanically coupled at an upstream end to a downstream end of the housing 312. When the crossover 350 and the head 355 are not integrated as a single component, the crossover 350 may be said to be mechanically coupled at a downstream end to an upstream end of the head 355.

Figure 3:
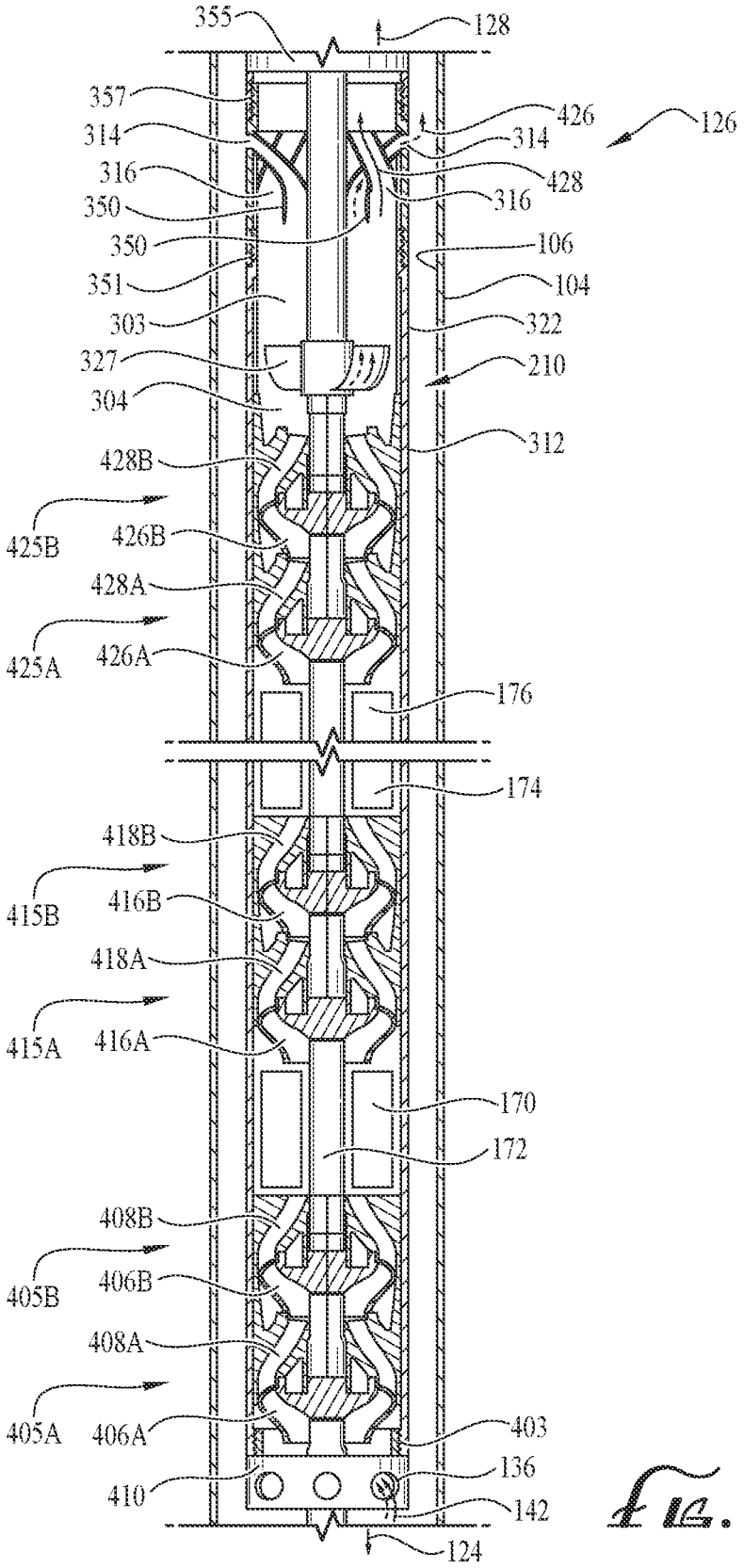
FIG. 3 is an illustration of another gas separator assembly according to an embodiment of the disclosure.

Turning now to FIG. 3, another embodiment of the gas separator assembly 126 is described. In an embodiment, the gas separator assembly 126 of FIG. 3 may be similar to the gas separator assembly 126 of FIG. 2A, FIG. 2B, FIG. 2C, and FIG. 2D but in addition may comprise a plurality of fluid reservoirs. In an embodiment, the gas separator assembly 126 may comprise a plurality of fluid reservoirs separated by a plurality of centrifugal pump stages 405, 415, 425.

For example, a second set of centrifugal pump stages 415 may be located within the housing 312 downstream of the fluid reservoir 170 and upstream of a second fluid reservoir 174. The second set of centrifugal pump stages 415 comprise a third pump stage 415A that comprises third impeller 416A mechanically coupled to the drive shaft 172 and a third diffuser 418A held stationary and retained by the housing 312, and a fourth pump stage 415B that comprises a fourth impeller 416B mechanically coupled to the drive shaft 172 and a fourth diffuser 418B held stationary and retained by the housing 312. One or more inlets of the third impeller 416A are fluidically coupled to the fluid reservoir 170. In another embodiment, the second set of centrifugal pump stages 415 may comprise a single centrifugal pump stage, three centrifugal pump stages, four centrifugal pump stages, five centrifugal pump stages, six centrifugal pump stages, or some other number of centrifugal pump stages. When the drive shaft 172 turns, the third impeller 416A and the fourth impeller 416B turn.

In an embodiment, the second fluid reservoir 174 is formed as an annulus between the outside of the drive shaft 172 and the interior wall of the housing 312. Alternatively, the second fluid reservoir 174 is formed as an annulus between the outside of the drive shaft 172 and an inside of a sleeve retained within the housing 312 that has an inlet at an upstream end of the second fluid reservoir 174 fluidically coupled to the outlets of the fourth diffuser 418B of the fourth centrifugal pump stage 415B and an outlet at a downstream end of the second fluid reservoir 174 that is fluidically coupled to another set of centrifugal pump stages, for example centrifugal pump stages 425.

A third fluid reservoir 176 may be located downstream of the second fluid reservoir 174 and upstream of a third set of centrifugal pump stages 425. In an embodiment, the third fluid reservoir 176 is formed as an annulus between the outside of the drive shaft 172 and the interior wall of the housing 312. Alternatively, the third fluid reservoir 176 is formed as an annulus between the outside of the drive shaft 172 and an inside of a sleeve retained within the housing 312 that has an inlet at an upstream end of the third fluid reservoir 176 and an outlet at a downstream end of the third fluid reservoir 176. Additional centrifugal pump stages (not shown) may be located between the second fluid reservoir 174 and the third fluid reservoir 176, for example between the cut lines in FIG. 3. Additional fluid reservoirs (not shown) may be located between the second fluid reservoir 174 and the third fluid reservoir 176, for example between the cut lines in FIG. 3. In an embodiment, one or more of the centrifugal pumps 405, 415, 425 may be provided by a different type of fluid mover, for example an auger mechanically coupled to the drive shaft 172, a paddle wheel mechanically coupled to the drive shaft 172, or an impeller mechanically coupled to the drive shaft 172. In an embodiment, an outlet of the second fluid reservoir 174 is fluidically coupled to an inlet of the third fluid reservoir 176. In an embodiment, the second fluid reservoir 174 may be fluidically coupled to the inlet of the third fluid reservoir 176 via internal passageways of one or more centrifugal pump stages located between the second and third fluid reservoirs 174, 176.

In an embodiment, the second fluid reservoir 174 and the third fluid reservoir 176 may not be separated by any centrifugal pump stages but may feature a spider bearing fixed to and retained by the inside of the housing 312 to support the drive shaft 170. A large fluid reservoir may be formed by stringing a plurality of fluid reservoirs together with spider bearings in between to support the drive shaft 170 at regular intervals, for example every 6 inches, every 8 inches, every 9 inches, every 10 inches, every 11 inches every 12 inches, every 13 inches, every 14 inches, or every 16 inches. The spacing between spider bearings may be dependent on a diameter of the drive shaft 170. For example, if the drive shaft 170 has a smaller diameter, the spider bearings may be placed more closely together; if the drive shaft 170 has a larger diameter, the spider bearings may be placed further apart.

The second fluid reservoir 174 provides the same function as the fluid reservoir 170 and extends yet further the amount of time that the ESP assembly 132 can sustain a gas slug (e.g., a bigger gas slug, a more extensive gas slug) without losing liquid phase fluid flow 154 to the centrifugal pump assembly 128, without bearings in the centrifugal pump assembly 128 overheating, and without the centrifugal pump assembly 128 experiencing gas lock. The third fluid reservoir 176 (and possibly additional fluid reservoirs between the second fluid reservoir 174 and the third fluid reservoir 176) again provides greater ability to sustain a gas slug for a longer period of time without losing liquid phase fluid flow 154 to the centrifugal pump assembly 128. The greater the sum of the volume of the fluid reservoir 170, the volume of the second fluid reservoir 174, and the volume of the third fluid reservoir (and the volumes of any further intervening fluid reservoirs), the longer duration of gas slug (the bigger the gas slug) that the ESP assembly 132 can sustain.

In an embodiment, the gas separator assembly 126 has one or more centrifugal pump stages downstream of the third fluid reservoir 176 and upstream of a paddle wheel 327 (In FIG. 3 the stationary auger 302 is replaced with a paddle wheel 327 that imparts rotating motion to the reservoir fluid 142 before it flows into the separation chamber 303), for example a fifth centrifugal pump stage 425A and a sixth centrifugal pump stage 425B. The fifth centrifugal pump stage 425A comprises a fifth impeller 426A mechanically coupled to the drive shaft 172 and a fifth diffuser 428A retained and held stationary by the housing 312. The sixth centrifugal pump stage 425B comprises a sixth impeller 426B mechanically coupled to the drive shaft 172 and a sixth diffuser 428B retained and held stationary by the housing 312. When the drive shaft 172 turns, the fifth impeller 426A and the sixth impeller 426B are turned. While two centrifugal pump stages 425A, 425B are illustrated downstream of the third fluid reservoir 176 and upstream of the paddle wheel 303, in another embodiment a single centrifugal pump stage, three centrifugal pump stages, four centrifugal pump stages, five centrifugal pump stages, six centrifugal pump stages, or more centrifugal pump stages may be located downstream of the third fluid reservoir 176 and upstream of the paddle wheel 327 in the gas separator assembly 126. The paddle wheel 327 is mechanically coupled to the drive shaft 172.

Figure 4:
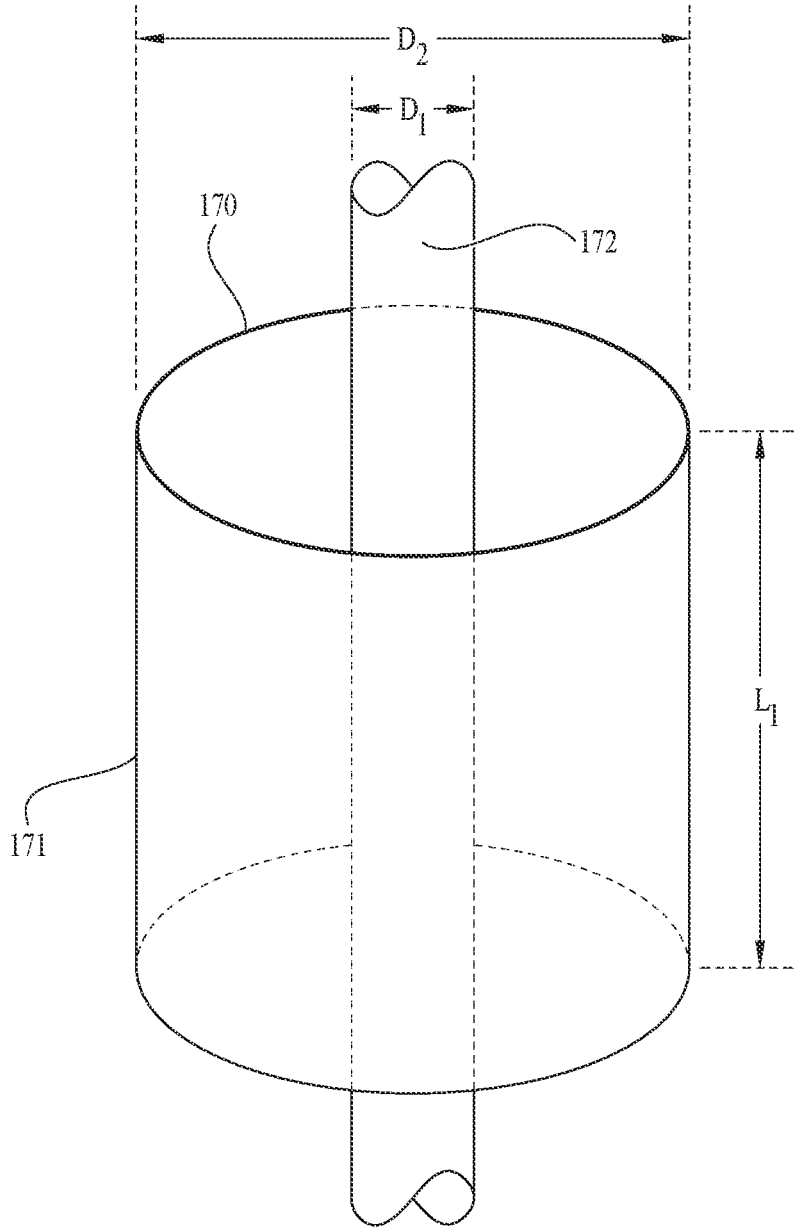
FIG. 4 is an illustration of an annulus in an interior of the gas separator assembly according to an embodiment of the disclosure.
Figure 5A:
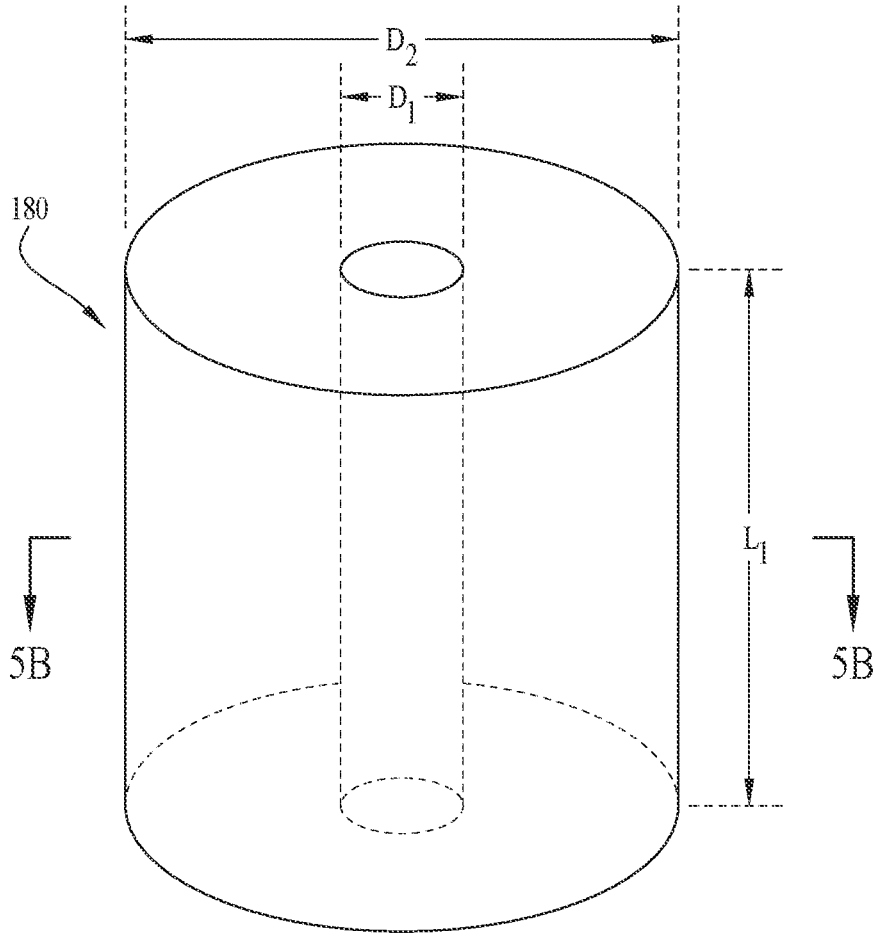
FIG. 5A is an illustration of an annular volume corresponding to the annulus in the interior of the gas separator assembly of FIG. 4.
Figure 5B:
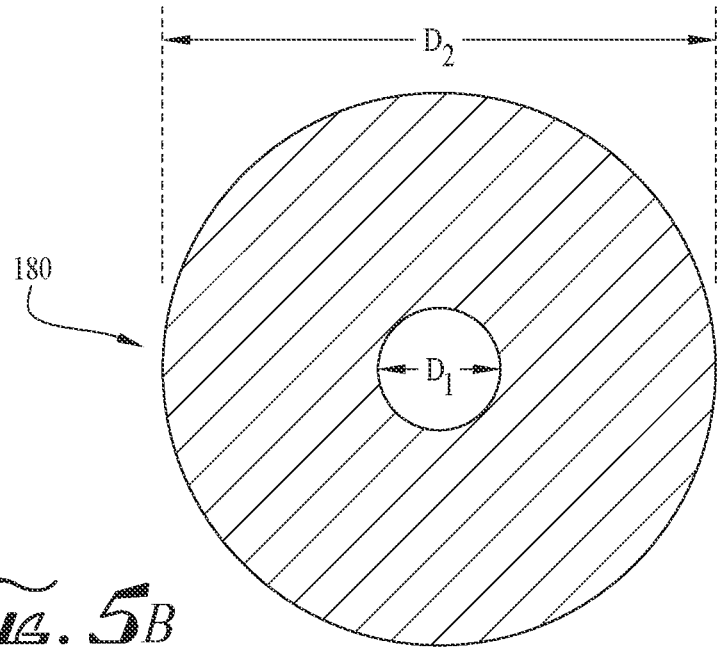
FIG. 5B is an illustration of a cross-sectional area of the annular volume of FIG. 5A.

Turning now to FIG. 4, the fluid reservoir 170 is illustrated as an annulus defined between the drive shaft 172 and the inner surface 171 (e.g., the inner wall of the housing 312 or a sleeve inside the inner wall of the housing 312). The annular volume of the annulus defined by the fluid reservoir is shown better in FIG. 5A and FIG. 5B. The volume may be found as the cross-sectional area of the annular volume 180 (best seen in FIG. 5B) multiplied by the length of the fluid reservoir 170 indicated as 'L1' in FIG. 4 and in FIG. 5A. The cross-sectional area of the annular volume 180 can be found as the difference of the area of a circle of diameter D2 (the inside diameter of the housing 312 or the inside diameter of the sleeve) and the area of a circle of diameter D1 (the diameter of the drive shaft 172). By increasing the sum volume of fluid reservoirs inside the gas separator assembly 126, the gas separator assembly 126 is able to sustain gas slugs of increasing duration.

In an embodiment, the fluid reservoir 170 is at least 2 inches long and less than 14 inches long. In an embodiment, the fluid reservoir 170 is at least 6 inches long and less than 14 inches long. In an embodiment, the fluid reservoir 170 is at least 14 inches long and less than 28 inches long. In an embodiment, the fluid reservoir 170 is at least 17 inches long and less than 34 inches long. In an embodiment, the fluid reservoir 170 is at least 24 inches long and less than 42 inches long. In an embodiment, the annular volume 180 of the fluid reservoir 170 is at least 18 cubic inches and less than 1000 cubic inches. In an embodiment, the annular volume 180 of the fluid reservoir 170 is at least 50 cubic inches and less than 1000 cubic inches. In an embodiment, the fluid reservoir 170 may comprise one or more spider bearings to support the drive shaft 172 as discussed further hereinafter.

In an embodiment, the gas separator assembly 126 may be less than 500 feet long and at least, 5 feet long, at least 8 feet long, at least 10 feet long, at least 12 feet long, at least 14 feet long, at least 16 feet long, at least 18 feet long, at least 20 feet long, at least 22 feet long, at least 24 feet long, at least 26 feet long, at least 28 feet long, at least 30 feet long, at least 32 feet long, at least 34 feet long, at least 40 feet long, at least 50 feet long, at least 60 feet long, at least 70 feet long, at least 80 feet long, at least 90 feet long, at least 100 feet long, at least 120 feet long, or at least 140 feet long. With long gas separator assemblies 126, the gas separator assembly may comprise a first housing that threadingly couples with a second housing, and the first housing and second housing joined together contain the centrifugal pump stages, the fluid reservoirs, and the stationary auger 302 of the gas separator assembly 126. With long gas separator assemblies 126, the drive shaft 172 may comprise two drive shafts that are coupled together by a spline coupling.

In an embodiment, during normal operation (e.g., there is no gas slug present at the inlet ports 136), liquid phase fluid may fill the annulus 210 from the downhole end of the gas separator assembly 126 (e.g., at the fluid inlets 136) to the level of the discharge ports 138. This liquid phase fluid may also mix with gas at the inlet ports 136 and in the centrifugal pump stages 405 when a gas slug hits the ESP assembly 132. Thus, the longer the gas separator assembly 126, the larger the volume of liquid phase fluid retained in the annulus 210 and the longer the ESP assembly 132 can sustain a gas slug while still feeding some liquid phase fluid to the centrifugal pump assembly 128. Thus, extending the length of the gas separator assembly 126 with fluid reservoirs 170, 174, 176 also may create additional liquid fluid reserves in the annulus 210.

Figure 6A:
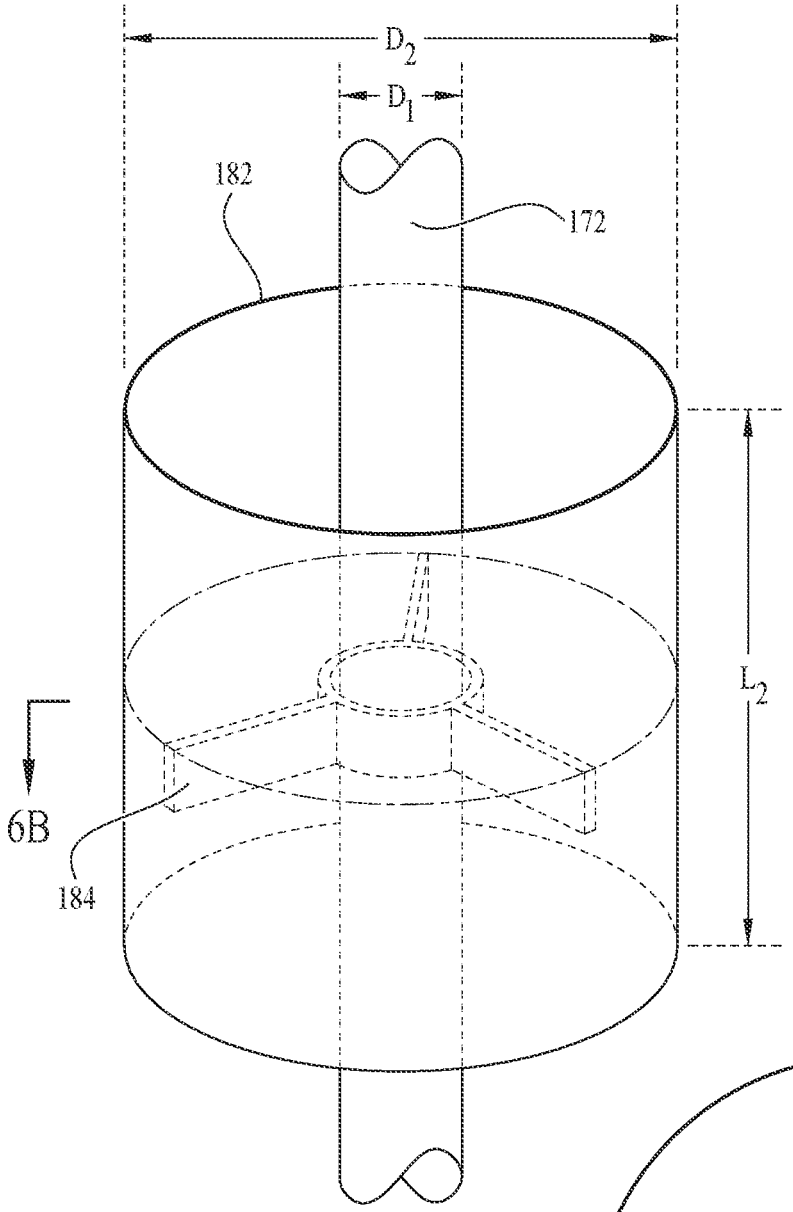
FIG. 6A is an illustration of another annulus and a spider bearing in an interior of the gas separator assembly according to an embodiment of the disclosure.
Figure 6B:
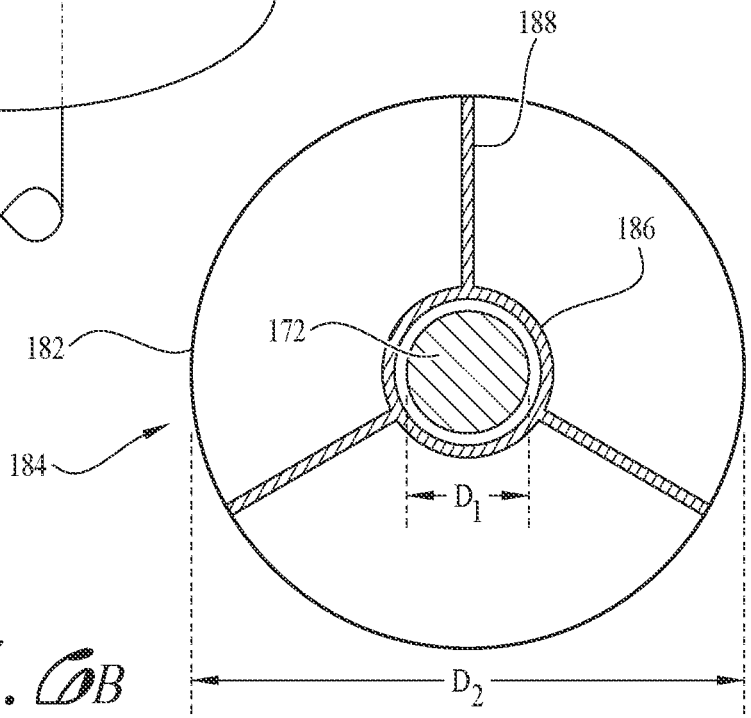
FIG. 6B is an illustration of a cross-section of the spider bearing according to an embodiment of the disclosure.
Figure 6C:
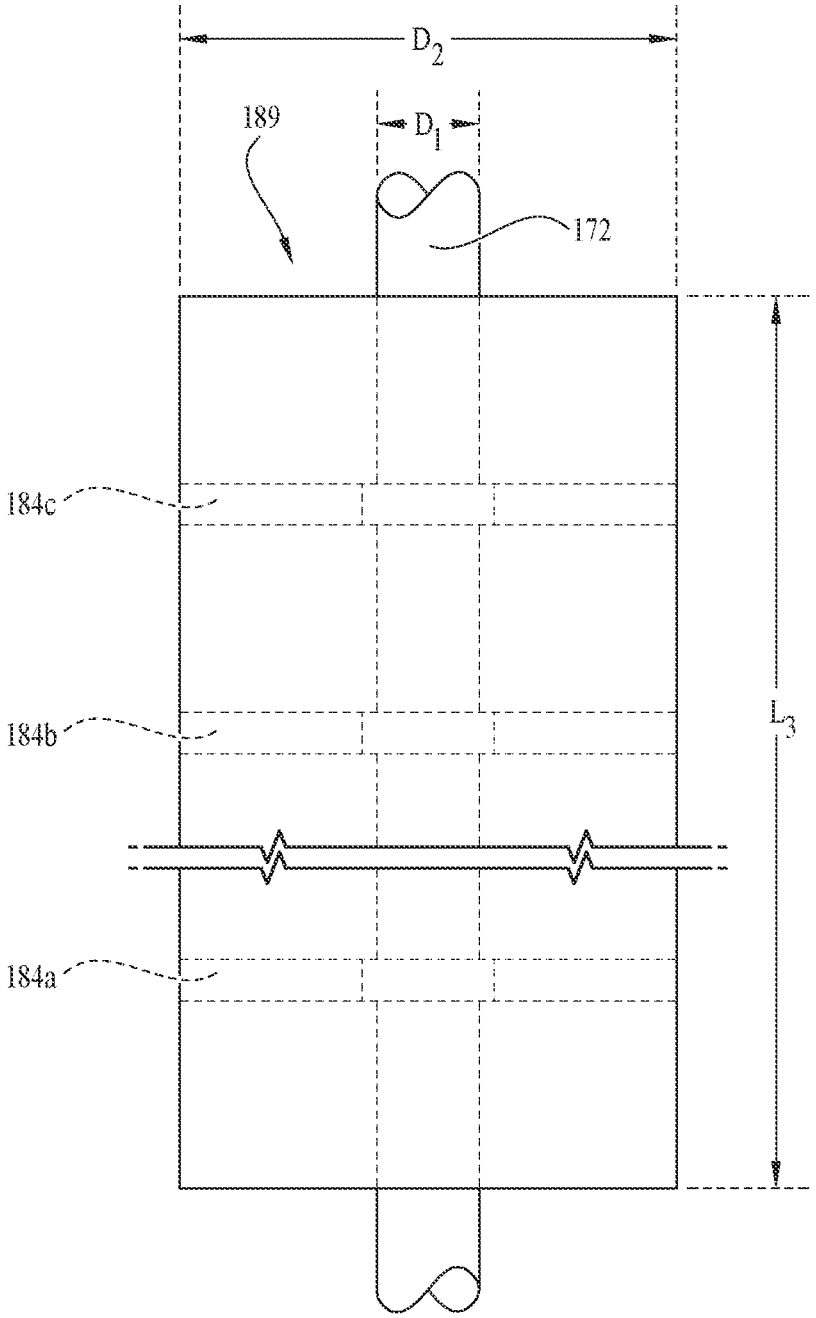
FIG. 6C is an illustration of yet another annulus and a plurality of spider bearings in an interior of the gas separator assembly according to an embodiment of the disclosure.

Turning now to FIG. 6A, an annular volume 182 is illustrated. A spider bearing 184 is illustrated in about a middle of the length L2 of the annular volume 182. By supporting the drive shaft 172 in a middle portion, the length L2 can be made greater, for example can be increased to 16 inches, 18 inches, 20 inches, 22 inches, 24 inches, 26 inches, or 28 inches. The use of spider bearings 184 can readily increase the sum of volumes of fluid reservoir within the gas separator and pump assembly 126. In FIG. 6B a different view of the spider bearing 184 is illustrated. The spider bearing 184 may comprise three struts 188 that stabilize a central bearing 186 of the spider bearing 184. The struts 188 may be secured by the housing 312. The struts 188 may take a shape of vanes oriented so as to minimally block the communication of reservoir fluid 142 through the spider bearing 184, between the struts 188. The spider bearing 184 provides fluid communication paths between the struts 188. While FIG. 6A and FIG. 6B illustrate a spider bearing 184 with three struts 188, the spider bearings 184 may comprise two struts, four struts, five struts, or some greater number of struts 188. In FIG. 6C, the number of spider bearings 184 may be increased to any number, thereby increasing the volume annular volume defined by the fluid reservoir 170, 174, 176. As shown in FIG. 6C, three spider bearings 184*a*, 184*b*, 184*c* are used and may provide a length L3 of the fluid reservoir 170, 174, 176 of 24 inches, 32, inches, 40 inches, 44 inches, 48 inches, 52 inches, or 56 inches.

In an embodiment, the drive shaft 172 has an outside diameter of about ⅞ inches (e.g., about 0.875 inches), and the gas separator assembly 126 has an outside diameter of about 4 inches. In this case, the inside diameter of the housing 312 or of the sleeve inside the inner wall of the housing 312 is about 3½ inches (e.g., 3.5 inches). These dimensions give a D1 value of about 0.875 inches, a D2 value of about 3.5 inches. The area of the cross-section in FIG. 5B for these values of D1 and D2 can be calculated to be about 9.0198 square inches. A corresponding annular volume can be calculated for a plurality of different values for L1 as per below:

| Value of L1 | Corresponding annular volume |
|---|---|
| 2" | 18.040 cubic inches |
| 4" | 36.079 cubic inches |
| 6" | 54.119 cubic inches |
| 8" | 72.158 cubic inches |
| 10" | 90.198 cubic inches |
| 12" | 108.24 cubic inches |
| 14" | 126.28 cubic inches |

In an embodiment, the drive shaft 172 has an outside diameter of about 11/16 inches (e.g., about 0.6875 inches), and the gas separator assembly 126 has an outside diameter of about 4 inches. In this case, the inside diameter of the housing 312 or of the sleeve inside the inner wall of the housing 312 is about 3½ inches (e.g., 3.5 inches). The area of the cross-section in FIG. 5B for these values of D1 and D2 can be calculated to be about 9.2499 square inches. A corresponding annular volume can be calculated for a plurality of different values for L1 as per below:

| Value of L1 | Corresponding annular volume |
|---|---|
| 2" | 18.500 cubic inches |
| 4" | 37.000 cubic inches |
| 6" | 55.499 cubic inches |
| 8" | 73.999 cubic inches |
| 10" | 92.499 cubic inches |
| 12" | 111.00 cubic inches |
| 14" | 129.50 cubic inches |

In an embodiment, the drive shaft 172 has an outside diameter of about 1 3/16 inches (e.g., about 1.1875 inches), and the gas separator assembly 126 has an outside diameter of about 5.38 inches. In this case, the inside diameter of the housing 312 or of the sleeve inside the inner wall of the housing 312 is about 4.77 inches. The area of the cross-section in FIG. 5B for these values of D1 and D2 can be calculated to be about 16.763 square inches. A corresponding annular volume can be calculated for a plurality of different values for L1 as per below:

| Value of L1 | Corresponding annular volume |
|---|---|
| 2" | 33.526 cubic inches |
| 4" | 67.052 cubic inches |
| 6" | 100.58 cubic inches |
| 8" | 134.10 cubic inches |
| 10" | 167.63 cubic inches |
| 12" | 201.16 cubic inches |
| 14" | 234.68 cubic inches |

-continued

| Value of L1 | Corresponding annular volume |
|---|---|

In an embodiment, the drive shaft 172 has an outside diameter of about 1 inch, and the gas separator assembly 126 has an outside diameter of about 5.38 inches. In this case, the inside diameter of the housing 312 or of the sleeve inside the inner wall of the housing 312 is about 4.77 inches. The area of the cross-section in FIG. 5B for these values of D1 and D2 can be calculated to be about 17.085 square inches. A corresponding annular volume can be calculated for a plurality of different values for L1 as per below:

| Value of L1 | Corresponding annular volume |
|---|---|
| 2" | 34.170 cubic inches |
| 4" | 68.340 cubic inches |
| 6" | 102.51 cubic inches |
| 8" | 136.68 cubic inches |
| 10" | 170.85 cubic inches |
| 12" | 205.02 cubic inches |
| 14" | 239.19 cubic inches |

The diameter of the drive shaft 172 and the inside diameter of the housing 312 or sleeve may be determined by the wellbore environment the ESP assembly 132 may be deployed to. By varying the length L1, however, more or less annular volume may be created in the fluid reservoir 170. More annular volume provides further buffer or reserve against gas slugs. At the same time, the length L1 may not be increased indefinitely because the drive shaft 172 may be unsupported and unstabilized in the fluid reservoir 170. In an embodiment, this length L1 may desirably be restricted to less than 16 inches, less than 15 inches, less than 14 inches, less than 13 inches, less than 12 inches, less than 11 inches, or less than 10 inches. The maximum prudent length of L1 depends upon the diameter of the drive shaft 172—the value of D1. A greater diameter drive shaft 172 may allow a relatively larger maximum length of L1 while a smaller diameter drive shaft 172 may allow a relatively smaller maximum length of L1. Greater annular volume—and hence greater ability to sustain gas slugs of long duration—can be provided either by increasing the length L1 or by increasing the number of fluid reservoirs within the gas separator assembly 126. Greater annular volume can be provided by increasing the length L1 by adding spider bearings 184 and desirable intervals within a single fluid reservoir to maintain the desired stability and support for the drive shaft 172.

It is noted that the substantial open volumes between centrifugal pump stages and a stationary auger taught herein are not conventionally included in gas separator assemblies because additional materials are required to do this (longer housing 312, for example), and longer spans where the drive shaft 172 is not supported occur.

Figure 7A:
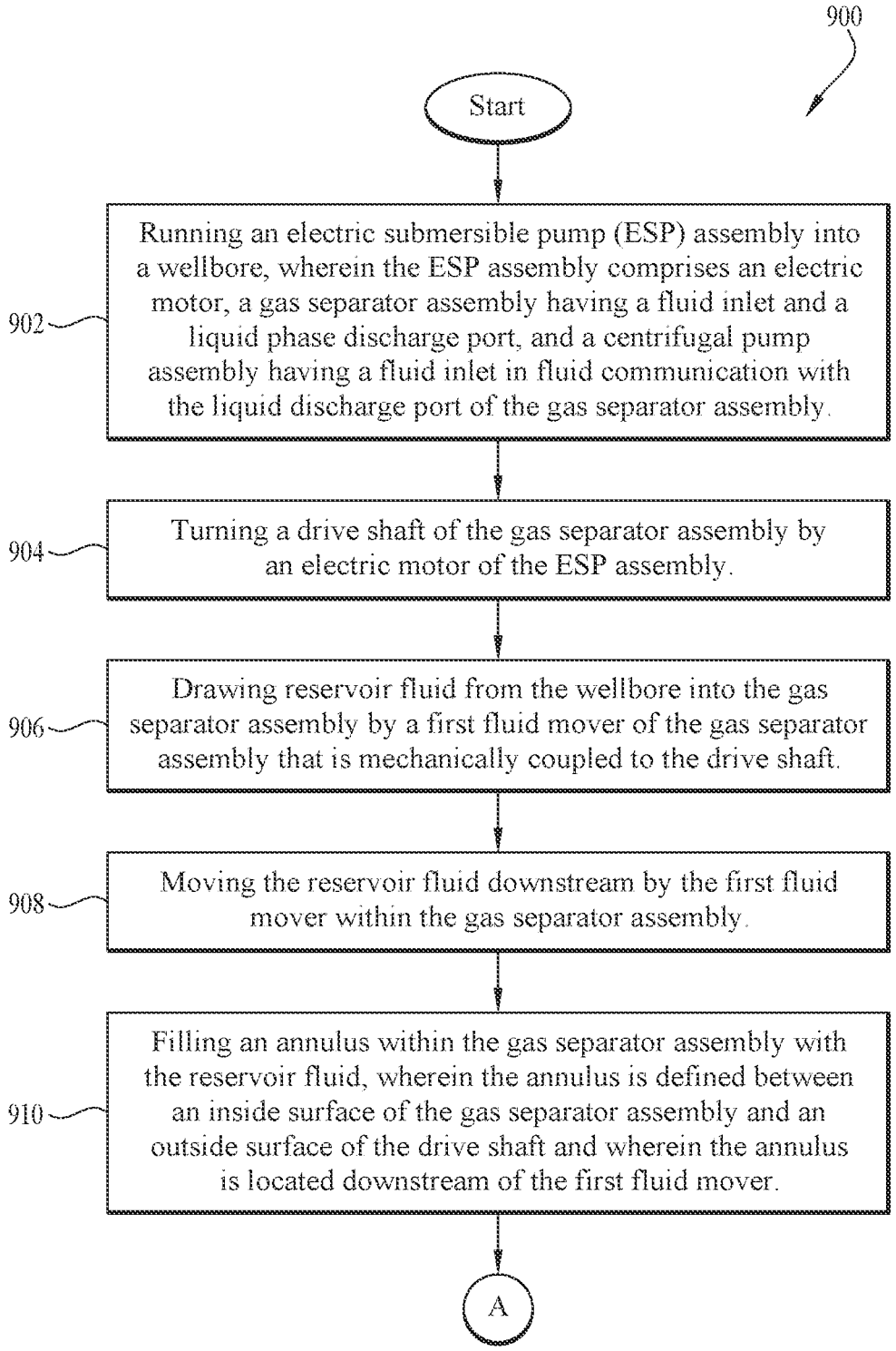
FIG. 7A and FIG. 7B is a flow chart of a method according to an embodiment of the disclosure.
Figure 7B:
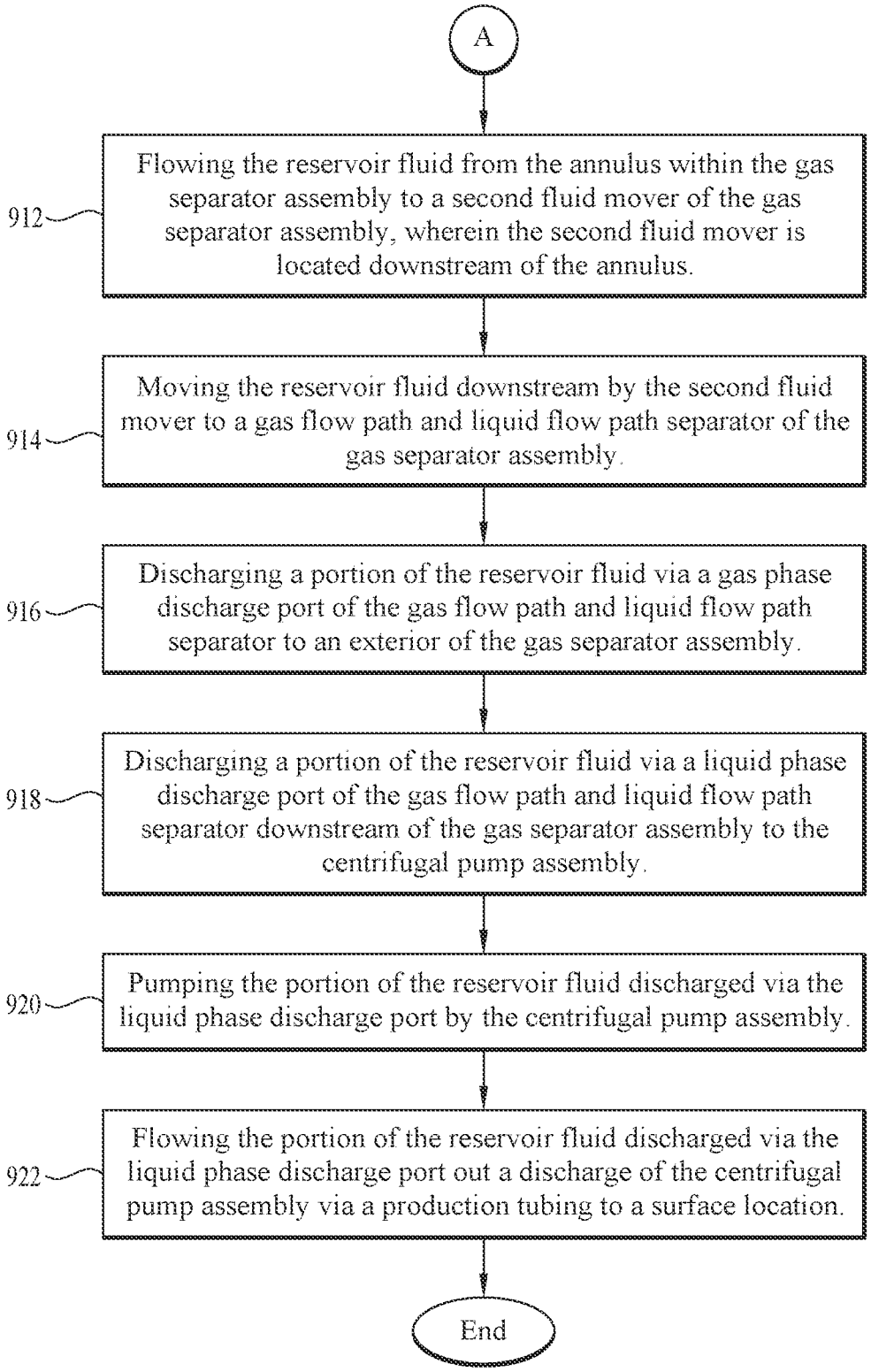
Figure 9:
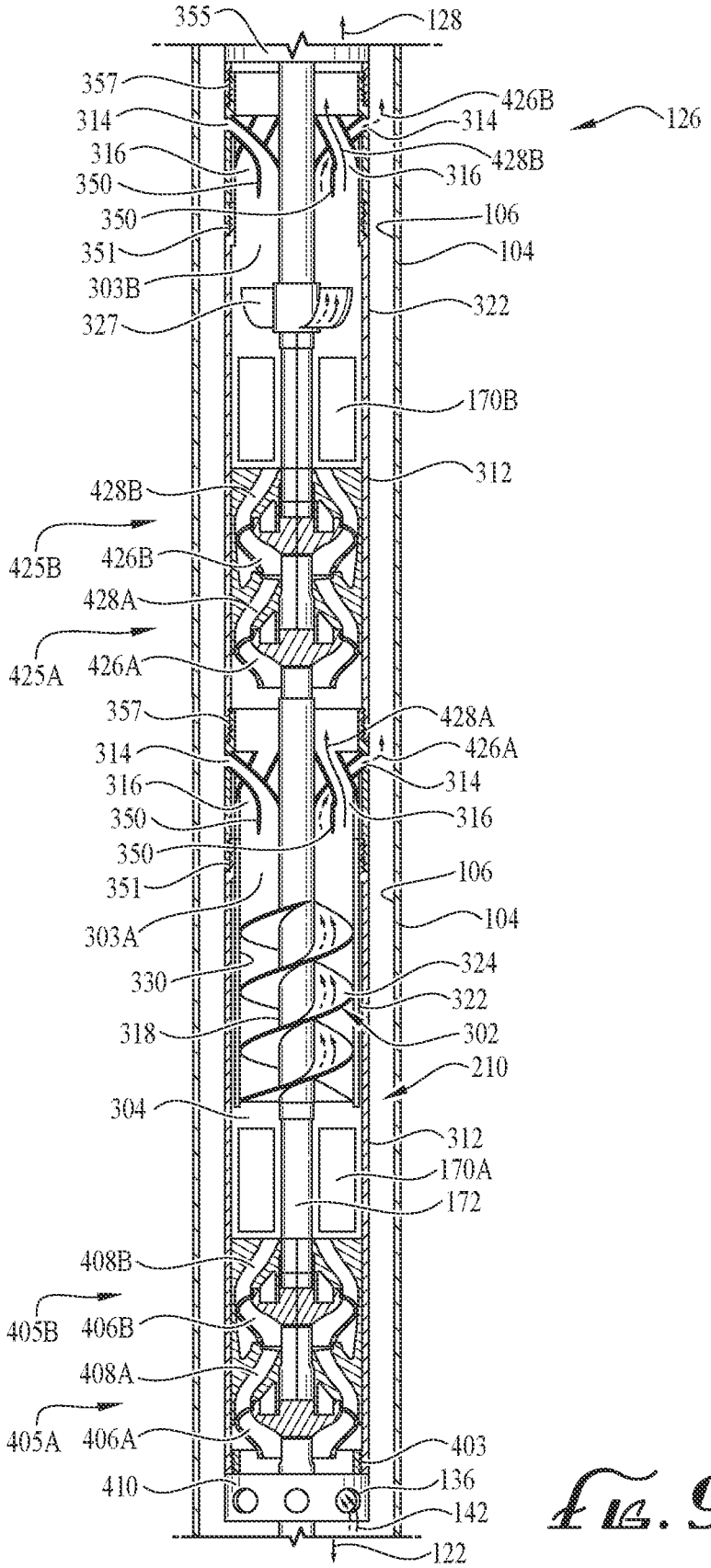
FIG. 9 is an illustration of a tandem gas separator assembly according to an embodiment of the disclosure.

Turning now to FIG. 7A and FIG. 7B, a method 900 is described. In an embodiment, the method 900 is a method of lifting liquid in a wellbore. At block 902, the method 900 comprises running an electric submersible pump (ESP) assembly into a wellbore, wherein the ESP assembly comprises an electric motor, a gas separator assembly having a fluid inlet and one or more liquid phase discharge ports (e.g., (A) a single set of one or more liquid phase discharge ports associated with a single cross-over or (B) two sets of one or more liquid phase discharge ports, where each set of liquid phase discharge ports is associated with a different crossover, as for example in a tandem gas separator configuration), and a centrifugal pump assembly having a fluid inlet fluidically coupled to the liquid discharge port of the gas separator assembly. In an embodiment, the method 900 may be practiced with a tandem gas separator assembly in place of the single gas separator assembly described here with reference to block 902. A tandem gas separator assembly is illustrated in FIG. 9 and described further below.

At block 904, the method 900 comprises turning a drive shaft of the gas separator assembly by an electric motor of the ESP assembly. At block 906, the method 900 comprises drawing reservoir fluid from the wellbore into the gas separator assembly by a first fluid mover of the gas separator assembly that is coupled to the drive shaft. At block 908, the method 900 comprises moving the reservoir fluid downstream by the first fluid mover (e.g., centrifugal pump stages 405A and 405B) within the gas separator assembly.

At block 910, the method 900 comprises filling an annulus within the gas separator assembly with the reservoir fluid, wherein the annulus is defined between an inside surface of the separator assembly and an outside surface of the drive shaft and wherein the annulus is located downstream of the first fluid mover. In an embodiment, the annulus is provided by the fluid reservoir 170 and may be defined between the drive shaft 172 and an inside surface of the housing 312 or by an inside surface of a sleeve retained by the housing 312. In an embodiment, a volume of the annulus is at least 50 cubic inches and less than 1000 cubic inches. At block 912, the method 900 comprises flowing the reservoir fluid from the annulus within the gas separator assembly to a second fluid mover of the gas separator assembly, wherein the second fluid mover is located downstream of the annulus. In an embodiment, the second fluid mover may be the stationary auger 302. In an embodiment, the second fluid mover may be the paddle wheel 327. In an embodiment, the second fluid mover may be an impeller without a diffuser.

At block 914, the method 900 comprises moving the reservoir fluid downstream by the second fluid mover to a gas flow path and liquid flow path separator (e.g., the crossover 350) of the gas separator assembly. In an embodiment, the processing of block 914 comprises inducing a rotating motion in the reservoir fluid by the second fluid mover and flowing the reservoir fluid into a separation chamber located downstream of the second fluid mover and upstream of the gas flow path and liquid flow path separator. In an embodiment, the processing of block 914 comprises separating gas phase fluid out from liquid phase fluid in the separation chamber by the rotating motion of the reservoir fluid. At block 916, the method 900 comprises discharging a portion of the reservoir fluid via a gas phase discharge port of the gas flow path and liquid flow path separator to an exterior of the gas separator assembly.

At block 918, the method 900 comprises discharging a portion of the reservoir fluid via a liquid phase discharge port of the by the gas flow path and liquid flow path separator downstream of the gas separator assembly to the centrifugal pump assembly.

At block 920, the method 900 comprises pumping the portion of the reservoir fluid discharged via the liquid phase discharge port by the centrifugal pump assembly. At block 922, the method 900 comprises flowing the portion of the reservoir fluid discharged via the liquid phase discharge port out a discharge of the centrifugal pump assembly via a production tubing to a surface location.

In an embodiment, the method 900 further comprises drawing gas from the wellbore into the gas separator by the first fluid mover; flowing the gas downstream by the first fluid mover within the gas separator assembly; mixing the gas with reservoir fluid retained by the annulus to form a mix of gas and fluid; and flowing the mix of gas and fluid from the annulus within the gas separator assembly to the second fluid mover of the gas separator assembly. In an embodiment, the method 900 further comprises stabilizing the drive shaft by a spider bearing that is concentric with the drive shaft and that is located inside the annulus within the gas separator assembly, wherein the spider bearing provides flow paths for the reservoir fluid between struts of the spider bearing. In an embodiment, the method 900 comprises stabilizing the drive shaft by a plurality of spider bearings, wherein each spider bearing is concentric with the drive shaft, is located inside the annulus within the gas separator assembly, and provides flow paths for the reservoir fluid between struts of the spider bearing. The plurality of spider bearings may be separated from each other by at least 4 inches and less than 16 inches, at least 6 inches and less than 14 inches, or at least 8 inches and less than 12 inches.

Figure 8A:
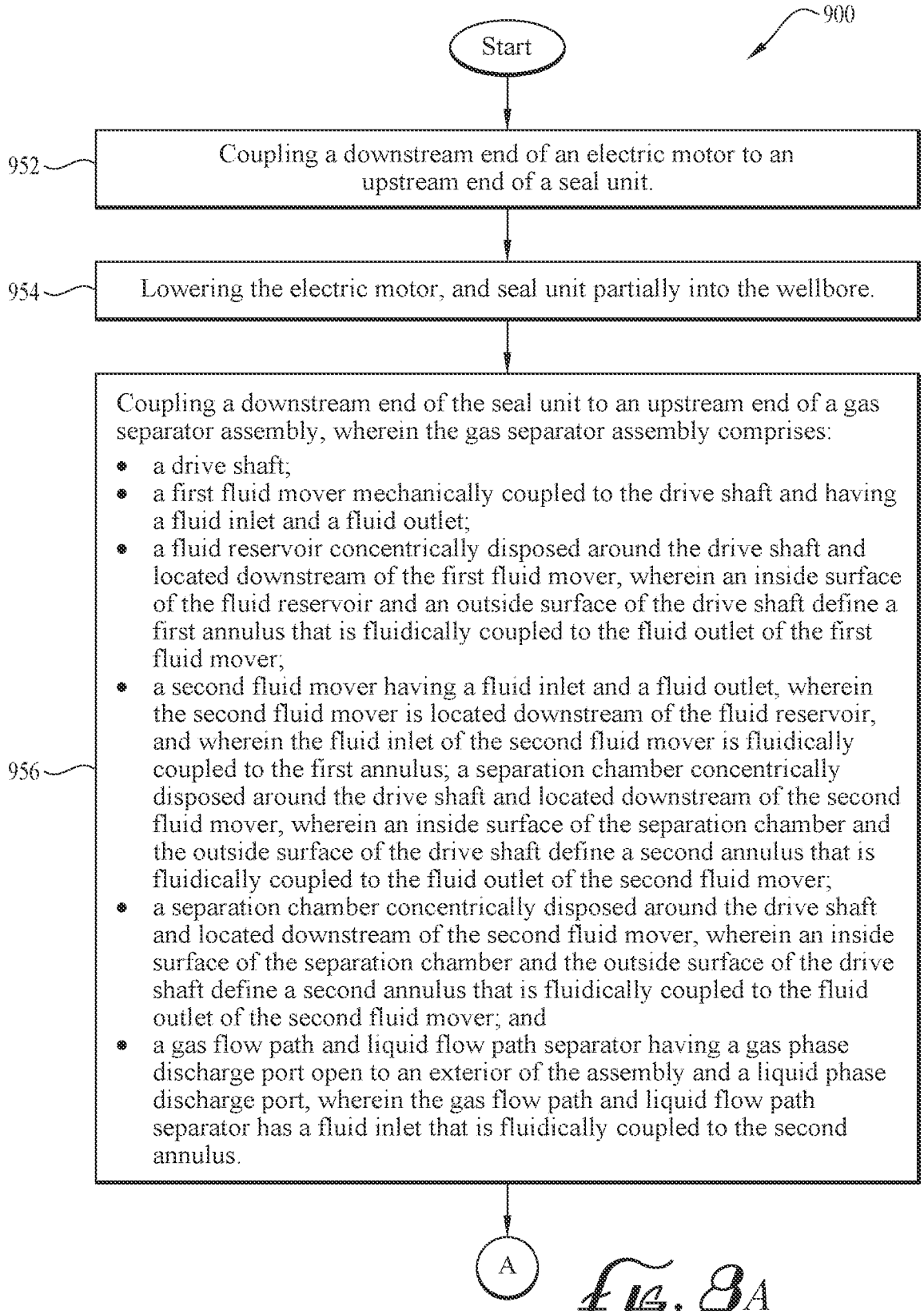
FIG. 8A and FIG. 8B is a flow chart of another method according to an embodiment of the disclosure.
Figure 8B:
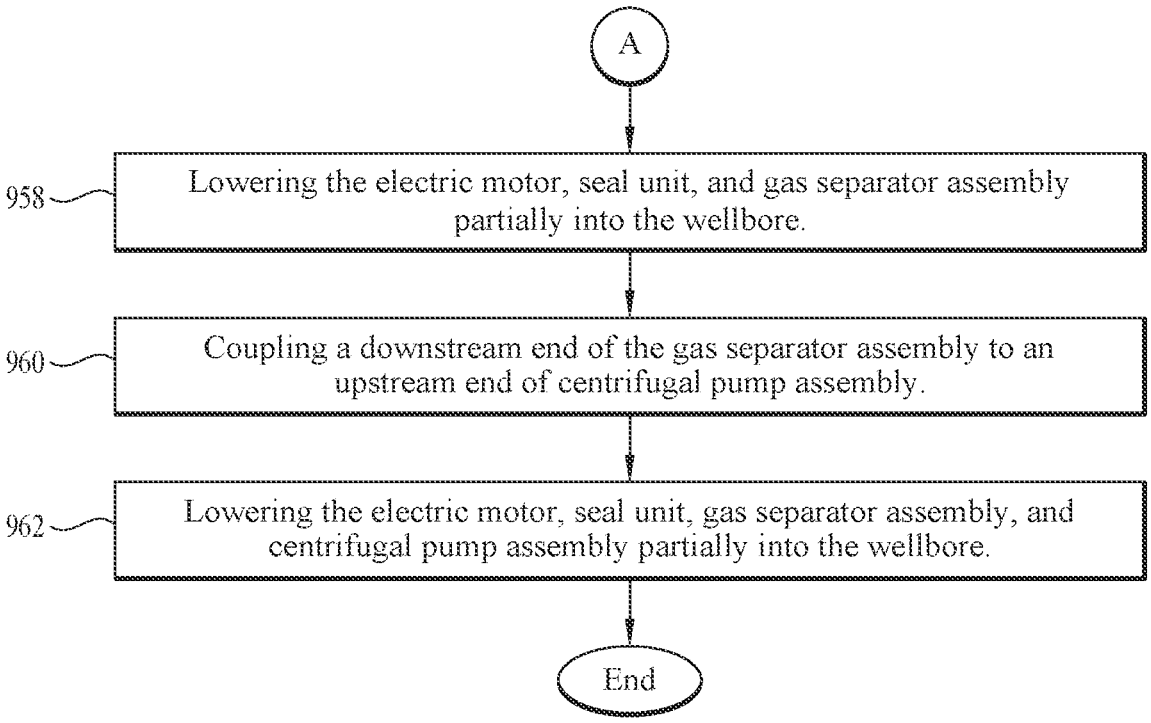

Turning now to FIG. 8A and FIG. 8B, a method 950 is described. In an embodiment, the method 950 is a method of assembling an electric submersible pump (ESP) assembly at a wellbore location. At block 952, the method 950 comprises coupling a downstream end of an electric motor to an upstream end of a seal unit. At block 954, the method 950 comprises lowering the electric motor, and seal unit partially into the wellbore.

At block 956, the method 950 comprises coupling a downstream end of the seal unit to an upstream end of a gas separator assembly, wherein the gas separator assembly comprises a drive shaft; a fluid reservoir concentrically disposed around the drive shaft and located downstream of the first fluid mover, wherein an inside surface of the fluid reservoir and an outside surface of the drive shaft define a first annulus that is fluidically coupled to the fluid outlet of the first fluid mover; a second fluid mover having a fluid inlet and a fluid outlet, wherein the second fluid mover is located downstream of the fluid reservoir, and wherein the fluid inlet of the second fluid mover is fluidically coupled to the first annulus; a separation chamber concentrically disposed around the drive shaft and located downstream of the second fluid mover, wherein an inside surface of the separation chamber and the outside surface of the drive shaft define a second annulus that is fluidically coupled to the fluid outlet of the second fluid mover; and a gas flow path and liquid flow path separator having a gas phase discharge port open to an exterior of the assembly and a liquid phase discharge port, wherein the gas flow path and liquid flow path separator has a fluid inlet that is fluidically coupled to the second annulus.

At block 958, the method 950 comprises lowering the electric motor, seal unit, and gas separator assembly partially into the wellbore. In an embodiment, the gas separator assembly comprises a spider bearing concentric with the drive shaft and located within the first fluid reservoir, wherein the spider bearing comprises struts that provide fluid communication paths between the struts. In an embodiment, the gas separator assembly comprises a plurality of spider bearings concentric with the drive shaft and located within the first fluid reservoir, wherein the spider bearings each comprises struts that provide fluid communication paths between the struts. In an embodiment, the gas separator assembly comprises a plurality of fluid reservoirs. In an embodiment, the gas separator assembly comprises a second fluid reservoir concentrically disposed around the drive shaft and located downstream of the second fluid mover, wherein an inside surface of the second fluid reservoir and an outside surface of the drive shaft define a second annulus that is fluidically coupled to the fluid outlet of the second fluid mover, wherein the second fluid mover is mechanically coupled to the drive shaft, and comprises a third fluid mover having a fluid inlet and a fluid outlet, wherein the third fluid mover is located downstream of the second fluid reservoir, and wherein the fluid inlet of the third fluid reservoir is fluidically coupled to the second fluid reservoir, wherein the separation chamber and the gas flow path and liquid flow path separator are located downstream of the third fluid mover, wherein the upstream end of the separation chamber is fluidically coupled to the fluid outlet of the third fluid mover, and wherein the fluid inlet of the separation chamber is fluidically coupled to the fluid outlet of the second fluid mover via the third fluid mover and via the second fluid reservoir.

At block 960, the method 950 comprises coupling a downstream end of the gas separator assembly to an upstream end of centrifugal pump assembly. At block 962, the method 950 comprises lowering the electric motor, seal unit, gas separator assembly, and centrifugal pump assembly partially into the wellbore.

Turning now to FIG. 9, a tandem gas separator configuration of the gas separator assembly 126 is described. A tandem gas separator assembly comprises two gas separator assemblies where an upstream gas separator assembly discharges liquid phase fluid out its crossover directly into the inlet of the first fluid mover of the downstream separator assembly, for example directly into an inlet of an impeller of a centrifugal pump stage. The upstream gas separator assembly has its own crossover and the downstream gas separator assembly has its own crossover. In an embodiment, a tandem gas separator assembly may be used to deliver a more liquid rich (e.g., lower gas fluid ratio) to the centrifugal pump assembly 128 by separating gas twice from the reservoir fluid 142. In an embodiment, since some of the reservoir fluid 142 (e.g., a gas phase rich fraction) is exhausted, the rate of flow of fluid into the downstream gas separator is inherently less than the rate of flow of fluid into the upstream gas separator. In an embodiment, the fluid movers of the upstream gas separator may be designed for a higher rate of flow of fluid, and the downstream gas separator may be designed for a lower rate of flow of fluid.

Much of the tandem gas separator assembly 126 illustrated in FIG. 9 is composed of components described above with reference to FIG. 2A, FIG. 2B, FIG. 2C, FIG. 2D, and FIG. 3. The tandem gas separator assembly 126 comprises a single base 410 have inlet ports 136. The upstream gas separator assembly comprises a centrifugal pump 405, a first fluid reservoir 170A, a stationary auger 302, a first separation chamber 303A, and a crossover 350. In an embodiment, the centrifugal pump 405 may be replaced in the upstream gas separator by an auger mechanically coupled to the drive shaft 172 or by a paddle wheel 327. In an embodiment, the stationary auger 302 may be replaced by a paddle wheel 327 mechanically coupled to the drive shaft 172 or an impeller mechanically coupled to the drive shaft 172. A first gas phase fluid 426A is discharged by the gas phase discharge 314 of the upstream gas separator into the annulus 210, and a first liquid phase fluid 428A is discharged by the liquid phase discharge 316 into the inlet of the centrifugal pump 425 of the downstream gas separator. Note that there is no base having inlet ports between the crossover 350 of the upstream gas separator and the centrifugal pump 425 of the downstream gas separator.

The downstream gas separator of the tandem gas separator assembly 126 comprises a centrifugal pump 425, a second fluid reservoir 170B, a paddle wheel 327, a second separation chamber 303B, and a crossover 350. In an embodiment, the centrifugal pump 425 may be replaced in the downstream gas separator by an auger mechanically coupled to the drive shaft 172. In an embodiment, the paddle wheel 327 may be replaced by a stationary auger 302 or by an impeller mechanically coupled to the drive shaft 172. A second gas phase fluid 426B is discharged by the gas phase discharge 314 of the downstream gas separator into the annulus 210, and a second liquid phase fluid 428B is discharged by the liquid phase discharge 316 to the centrifugal pump assembly 128.

ADDITIONAL DISCLOSURE

The following are non-limiting, specific embodiments in accordance with the present disclosure:

A first embodiment, which is a downhole gas separator assembly, comprising a drive shaft, a first fluid mover mechanically coupled to the drive shaft and having a fluid inlet and a fluid outlet, a fluid reservoir concentrically disposed around the drive shaft and located downstream of the first fluid mover, wherein an inside surface of the fluid reservoir and an outside surface of the drive shaft define a first annulus that is fluidically coupled to the fluid outlet of the first fluid mover, a second fluid mover having a fluid inlet and a fluid outlet, wherein the second fluid mover is located downstream of the fluid reservoir, and wherein the fluid inlet of the second fluid mover is fluidically coupled to the first annulus, a separation chamber concentrically disposed around the drive shaft and located downstream of the second fluid mover, wherein an inside surface of the separation chamber and the outside surface of the drive shaft define a second annulus that is fluidically coupled to the fluid outlet of the second fluid mover, and a gas flow path and liquid flow path separator having a gas phase discharge port open to an exterior of the assembly and a liquid phase discharge port, wherein the gas flow path and liquid flow path separator has a fluid inlet that is fluidically coupled to the second annulus.

A second embodiment, which is the downhole gas separator assembly of the first embodiment, wherein the first annulus has a volume of at least 18 cubic inches and less than 1000 cubic inches.

A third embodiment, which is the downhole gas separator assembly of any of the first and the second embodiments, wherein a distance between the fluid inlet of the first fluid mover and the gas phase discharge port of the gas flow path and liquid flow path separator is at least 4 feet and less than 500 feet.

A fourth embodiment, which is the downhole gas separator assembly of any of the first through the third embodiments, wherein the fluid reservoir is at least 6 inches long and less than 17 inches long.

A fifth embodiment, which is the downhole gas separator assembly of any of the first through the fourth embodiments, further comprising a spider bearing located within the fluid reservoir that has a central through-hole that surrounds the drive shaft.

A sixth embodiment, which is the downhole gas separator assembly of the fifth embodiment, wherein the fluid reservoir is at least 17 inches long and less than 34 inches long.

A seventh embodiment, which is the downhole gas separator assembly of any of the first through the sixth embodiments, further comprising a housing, wherein the inside surface of the fluid reservoir and the inside surface of the separation chamber is provided by an inside surface of the housing, wherein the first fluid mover and the second fluid mover are located within the housing, and wherein the gas flow path and liquid flow path separator is mechanically coupled to the housing.

An eighth embodiment, which is the downhole gas separator assembly of any of the first through the seventh embodiments, further comprising a housing, wherein the inside surface of the separation chamber is provided by an inside surface of the housing, wherein the inside surface of the fluid reservoir is provided by a sleeve that is retained within the housing, wherein the first fluid mover and the second fluid mover are located within the housing, and wherein the gas flow path and liquid flow path separator is mechanically coupled to the housing.

A ninth embodiment, which is the downhole gas separator assembly of any of the first through the eighth embodiments, wherein the second fluid mover is a stationary auger, an auger mechanically coupled to the drive shaft, an impeller mechanically coupled to the drive shaft, a centrifuge rotor mechanically coupled to the drive shaft, or a paddle wheel mechanically coupled to the drive shaft.

A tenth embodiment, which is the downhole gas separator assembly of any of the first through the ninth embodiments, wherein the first fluid mover is a centrifugal pump having at least one centrifugal pump stage wherein each centrifugal pump stage comprises an impeller mechanically coupled to the drive shaft and a diffuser.

An eleventh embodiment, which is the downhole gas separator assembly of any of the first through the tenth embodiments, wherein the second fluid mover is mechanically coupled to the drive shaft and further comprising a second fluid reservoir concentrically disposed around the drive shaft and located downstream of the second fluid mover, wherein an inside surface of the second fluid reservoir and an outside surface of the drive shaft define a third annulus that is fluidically coupled to the fluid outlet of the second fluid mover, and a third fluid mover having a fluid inlet and a fluid outlet, wherein the third fluid mover is located downstream of the second fluid reservoir and is located upstream of the separation chamber, wherein the fluid inlet of the third fluid mover is fluidically coupled to the third annulus, and wherein the fluid outlet of the third fluid mover is fluidically coupled to the second annulus.

A twelfth embodiment, which is the downhole gas separator assembly of any of the first through the eleventh embodiments, further comprising a base having an inlet, a fourth fluid mover mechanically coupled to the drive shaft, located upstream of the base, having a fluid outlet, and having a fluid inlet fluidically coupled to the inlet of the base, a third fluid reservoir concentrically disposed around the drive shaft and located downstream of the fourth fluid mover, wherein an inside surface of the third fluid reservoir and the outside surface of the drive shaft define a fourth annulus that is fluidically coupled to the fluid outlet of the fourth fluid mover, a fifth fluid mover having a fluid inlet and a fluid outlet, wherein the fifth fluid mover is located downstream of the third fluid reservoir, and wherein the fluid inlet of the fifth fluid mover is fluidically coupled to the fourth annulus, a second separation chamber concentrically disposed around the drive shaft and located downstream of the fifth fluid mover, wherein an inside surface of the second separation chamber and the outside surface of the drive shaft define a fifth annulus that is fluidically coupled to the fluid outlet of the fifth fluid mover, and a second gas flow path and liquid flow path separator having a gas phase discharge port open to an exterior of the assembly and a liquid phase discharge port fluidically coupled to the fluid inlet of the first fluid mover, and wherein the gas flow path and liquid flow path separator has a fluid inlet fluidically coupled to the fifth annulus.

A thirteenth embodiment, which is a method of lifting liquid in a wellbore, comprising running an electric submersible pump (ESP) assembly into a wellbore, wherein the ESP assembly comprises an electric motor, a gas separator assembly having a fluid inlet and a liquid phase discharge port, and a centrifugal pump assembly having a fluid inlet fluidically coupled to the liquid discharge port of the gas separator assembly, turning a drive shaft of the gas separator assembly by an electric motor of the ESP assembly, drawing reservoir fluid from the wellbore into the gas separator assembly by a first fluid mover of the gas separator assembly that is coupled to the drive shaft, moving the reservoir fluid downstream by the first fluid mover within the gas separator assembly, filling an annulus within the gas separator assembly with the reservoir fluid, wherein the annulus is defined between an inside surface of the gas separator assembly and an outside surface of the drive shaft and wherein the annulus is located downstream of the first fluid mover, flowing the reservoir fluid from the annulus within the gas separator assembly to a second fluid mover of the gas separator, wherein the second fluid mover is located downstream of the annulus, moving the reservoir fluid downstream by the second fluid mover to a gas flow path and liquid flow path separator of the gas separator assembly, discharging a portion of the reservoir fluid via a gas phase discharge port of the gas flow path and liquid flow path separator to an exterior of the gas separator assembly, discharging a portion of the reservoir fluid via a liquid phase discharge port of the gas flow path and liquid flow path separator downstream of the gas separator assembly to the centrifugal pump assembly, pumping the portion of the reservoir fluid discharged via the liquid phase discharge port by the centrifugal pump assembly, and flowing the portion of the reservoir fluid discharged via the liquid phase discharge port out a discharge of the centrifugal pump assembly via a production tubing to a surface location.

A fourteenth embodiment, which is the method of the thirteenth embodiment further comprising drawing gas from the wellbore into the gas separator by the first fluid mover, flowing the gas downstream by the first fluid mover within the gas separator assembly, mixing the gas with reservoir fluid retained by the annulus to form a mix of gas and fluid, and flowing the mix of gas and fluid from the annulus within the gas separator assembly to the second fluid mover of the gas separator assembly.

A fifteenth embodiment, which is the method of the fourteenth embodiment, wherein a volume of the annulus is at least 50 cubic inches and less than 1000 cubic inches.

A sixteenth embodiment, which is the method of the twelfth embodiment, further comprising stabilizing the drive shaft by a spider bearing that is concentric with the drive shaft and that is located inside the annulus within the gas separator assembly, wherein the spider bearing provides flow paths for the reservoir fluid between struts of the spider bearing.

A seventeenth embodiment, which is the method of the twelfth embodiment, further comprising stabilizing the drive shaft by a plurality of spider bearings, wherein each spider bearing is concentric with the drive shaft, is located inside the annulus within the gas separator assembly, and provides flow paths for the reservoir fluid between struts of the spider bearing.

An eighteenth embodiment, which is the method of the seventeenth embodiment, wherein each spider bearing is separated from the other spider bearing by at least 4 inches and less than 16 inches.

A nineteenth embodiment, which is a method of assembling an electric submersible pump (ESP) assembly at a wellbore location, comprising coupling a downstream end of an electric motor to an upstream end of a seal unit, lowering the electric motor, and seal unit partially into the wellbore, coupling a downstream end of the seal unit to an upstream end of a gas separator assembly, wherein the gas separator assembly comprises a drive shaft, a first fluid mover mechanically coupled to the drive shaft and having a fluid inlet and a fluid outlet, a fluid reservoir concentrically disposed around the drive shaft and located downstream of the first fluid mover, wherein an inside surface of the fluid reservoir and an outside surface of the drive shaft define a first annulus that is fluidically coupled to the fluid outlet of the first fluid mover, a second fluid mover having a fluid inlet and a fluid outlet, wherein the second fluid mover is located downstream of the fluid reservoir, and wherein the fluid inlet of the second fluid mover is fluidically coupled to the first annulus, a separation chamber concentrically disposed around the drive shaft and located downstream of the second fluid mover, wherein an inside surface of the separation chamber and the outside surface of the drive shaft define a second annulus that is fluidically coupled to the fluid outlet of the second fluid mover, and a gas flow path and liquid flow path separator having a gas phase discharge port open to an exterior of the assembly and a liquid phase discharge port, wherein the gas flow path and liquid flow path separator has a fluid inlet that is fluidically coupled to the second annulus, lowering the electric motor, seal unit, and gas separator assembly partially into the wellbore, coupling a downstream end of the gas separator assembly to an upstream end of centrifugal pump assembly, and lowering the electric motor, seal unit, gas separator assembly, and centrifugal pump assembly partially into the wellbore.

A twentieth embodiment, which is the method of the nineteenth embodiment, wherein the gas separator assembly comprises a plurality of fluid reservoirs.

A twenty-first embodiment, which is the method of any of the nineteenth and the twentieth embodiments, wherein the second fluid mover is mechanically coupled to the drive shaft and gas separator assembly comprises a second fluid reservoir concentrically disposed around the drive shaft and located downstream of the second fluid mover, wherein an inside surface of the second fluid reservoir and an outside surface of the drive shaft define a second annulus that is fluidically coupled to the fluid outlet of the second fluid mover, and a third fluid mover having a fluid inlet and a fluid outlet, wherein the third fluid mover is located downstream of the second fluid reservoir, and wherein the fluid inlet of the third fluid reservoir is fluidically coupled to the second fluid reservoir, wherein the gas flow path and liquid flow path separator is located downstream of the third fluid mover, wherein the fluid inlet of the gas flow path and liquid flow path separator is in fluidically coupled to the fluid outlet of the third fluid mover, and wherein the fluid inlet of the gas flow path and liquid flow path separator is fluidically coupled to the fluid outlet of the second fluid mover via the third fluid mover and via the second fluid reservoir.

A twenty-second embodiment, which is the method of any of the nineteen through the twenty-first embodiments, wherein the gas separator assembly further comprises a spider bearing concentric with the drive shaft and located within the first fluid reservoir, wherein the spider bearing comprises struts that provide fluid communication paths between the struts.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. A downhole gas separator assembly, comprising:

a drive shaft;

a first fluid reservoir concentrically disposed around the drive shaft wherein an inside surface of the first fluid reservoir and an outside surface of the drive shaft define a first annulus within a portion of the first fluid reservoir that does not enclose a radial support of the drive shaft, wherein when the separator drive shaft is about 0.6875 inches in diameter, the first annulus has a volume of at least 70 cubic inches and less than 100 cubic inches; wherein when the separator drive shaft is about 0.875 inches in diameter, the first annulus has a volume of at least 85 cubic inches and less than 120 cubic inches; wherein when the separator drive shaft is about 1.0 inches in diameter, the first annulus has a volume of at least 180 cubic inches and less than 250 cubic inches; and wherein when the separator drive shaft is about 1.1875 inches in diameter, the first annulus has a volume of at least 220 cubic inches and less than 300 cubic inches;

a first fluid mover having a fluid inlet and a fluid outlet, wherein the first fluid mover is located downstream of the first fluid reservoir, and wherein the fluid inlet of the first fluid mover is fluidically coupled to the first annulus;

a separation chamber concentrically disposed around the drive shaft and located downstream of the first fluid mover, wherein an inside surface of the separation chamber and the outside surface of the drive shaft define a second annulus that is fluidically coupled to the fluid outlet of the first fluid mover; and a crossover defining a gas flow path and liquid flow path separator having a gas phase discharge port open to an exterior of the assembly and a liquid phase discharge port, wherein the gas flow path and liquid flow path separator has a fluid inlet that is fluidically coupled to the second annulus.

2. The downhole gas separator assembly of claim 1, wherein a distance between a downhole end of the downhole gas separator assembly and the gas phase discharge port of the crossover is at least 8 feet and less than 500 feet.

3. The downhole gas separator assembly of claim 1, wherein a distance between a downhole end of the downhole gas separator assembly and the gas phase discharge port of the crossover is at least 14 feet and less than 500 feet.

4. The downhole gas separator assembly of claim 1, wherein a distance between a downhole end of the downhole gas separator assembly and the gas phase discharge port of the crossover is at least 22 feet and less than 500 feet.

5. The downhole gas separator assembly of claim 1, further comprising a spider bearing comprising a plurality of vanes, wherein the spider bearing is concentric with the drive shaft, the spider bearing is located within the first fluid reservoir, and the spider bearing provides flow paths between the vanes.

6. The downhole gas separator assembly of claim 5, wherein the first fluid reservoir is at least 17 inches long and less than 34 inches long.

7. The downhole gas separator assembly of claim 5, wherein the spider bearing comprises four vanes.

8. The downhole gas separator assembly of claim 5, wherein the spider bearing comprises five vanes.

9. The downhole gas separator assembly of claim 1, wherein the first fluid mover is a stationary auger, an auger mechanically coupled to the drive shaft, an impeller mechanically coupled to the drive shaft, or a paddle wheel mechanically coupled to the drive shaft.

10. The downhole gas separator assembly of claim 1, further comprising a second fluid mover disposed around the drive shaft and located downstream of the first fluid reservoir.

11. The downhole gas separator assembly of claim 10, further comprising:

a second fluid reservoir concentrically disposed around the drive shaft and located downstream of the first fluid mover, wherein an inside surface of the second fluid reservoir and an outside surface of the drive shaft define a third annulus that is fluidically coupled to the fluid outlet of the second fluid mover; and a third fluid mover having a fluid inlet and a fluid outlet, wherein the third fluid mover is located downstream of the second fluid reservoir and is located upstream of the separation chamber, wherein the fluid inlet of the third fluid mover is fluidically coupled to the third annulus, and wherein the fluid outlet of the third fluid mover is fluidically coupled to the second annulus.

12. The downhole gas separator assembly of claim 1, further comprising:

a base having an inlet;

a second fluid mover mechanically coupled to the drive shaft, located downstream of the base, having a fluid outlet, and having a fluid inlet fluidically coupled to the inlet of the base;

a second fluid reservoir concentrically disposed around the drive shaft and located downstream of the second fluid mover, wherein an inside surface of the second fluid reservoir and the outside surface of the drive shaft define a third annulus that is fluidically coupled to the fluid outlet of the second fluid mover;

a third fluid mover having a fluid inlet and a fluid outlet, wherein the third fluid mover is located downstream of the second fluid reservoir, and wherein the fluid inlet of the third fluid mover is fluidically coupled to the third annulus;

a second separation chamber concentrically disposed around the drive shaft and located downstream of the third fluid mover, wherein an inside surface of the second separation chamber and the outside surface of the drive shaft define a fourth annulus that is fluidically coupled to the fluid outlet of the third fluid mover; and a second crossover defining a gas flow path and liquid flow path separator having a second gas phase discharge port open to an exterior of the assembly and a second liquid phase discharge port fluidically coupled to the fluid inlet of the first fluid reservoir, and wherein the second crossover has a fluid inlet fluidically coupled to the fourth annulus.

13. A method of lifting liquid in a wellbore, comprising:

running an electric submersible pump (ESP) assembly into a wellbore, wherein the ESP assembly comprises an electric motor having a motor drive shaft, a seal section having a seal drive shaft coupled to the motor drive shaft, a gas separator assembly having a separator drive shaft coupled to the seal drive shaft, a fluid reservoir concentrically disposed around the separator drive shaft, wherein an inside surface of the fluid reservoir and an outside surface of the separator drive shaft define a first annulus within a portion of the fluid reservoir that does not enclose a radial support of the drive shaft, wherein when the separator drive shaft is about 0.6875 inches in diameter, the first annulus has a volume of at least 70 cubic inches and less than 100 cubic inches; wherein when the separator drive shaft is about 0.875 inches in diameter, the first annulus has a volume of at least 85 cubic inches and less than 120 cubic inches; wherein when the separator drive shaft is about 1.0 inches in diameter, the first annulus has a volume of at least 180 cubic inches and less than 250 cubic inches; and wherein when the separator drive shaft is about 1.1875 inches in diameter, the first annulus has a volume of at least 220 cubic inches and less than 300 cubic inches, a first fluid mover having a fluid inlet and a fluid outlet, wherein the first fluid mover is located downstream of the fluid reservoir, and wherein the fluid inlet of the first fluid mover is fluidically coupled to the first annulus, a separation chamber concentrically disposed around the separator drive shaft and located downstream of the first fluid mover, wherein an inside surface of the separation chamber and the outside surface of the separator drive shaft define a second annulus that is fluidically coupled to the fluid outlet of the first fluid mover, and a crossover defining a gas flow path and liquid flow path separator having a gas phase discharge port open to an exterior of the assembly and a liquid phase discharge port, wherein the crossover has a third fluid inlet that is fluidically coupled to the second annulus, and a centrifugal pump assembly having a pump drive shaft coupled to the separator drive shaft and a fluid inlet fluidically coupled to the liquid discharge port of the crossover of the gas separator assembly;

turning the separator drive shaft by the electric motor of the ESP assembly;

drawing reservoir fluid from the wellbore into the gas separator assembly;

filling the first annulus with the reservoir fluid;

flowing the reservoir fluid from the first annulus to the first fluid mover moving the reservoir fluid downstream by the first fluid mover to the crossover;

discharging at least some of the gas phase fluid portion of the reservoir fluid via the gas phase discharge port of the crossover to an exterior of the gas separator assembly;

discharging at least some of the liquid phase portion of the reservoir fluid via the liquid phase discharge port of the crossover to the centrifugal pump assembly;

pumping the portion of the reservoir fluid discharged via the liquid phase discharge port by the centrifugal pump assembly; and flowing the portion of the reservoir fluid discharged via the liquid phase discharge port out a discharge of the centrifugal pump assembly via a production tubing to a surface location.

14. The method of claim 13, further comprising:

drawing reservoir fluid from the wellbore into the gas separator assembly at a second time, wherein the reservoir fluid at the second time contains only gas phase fluid;

mixing the reservoir fluid containing only gas phase fluid with reservoir fluid retained by the first annulus within the gas separator assembly to form a mix of gas phase fluid and liquid phase fluid; and flowing the mix of gas phase fluid and liquid phase fluid from the first annulus within the gas separator assembly to the first fluid mover of the gas separator assembly.

15. The method of claim 13, further comprising stabilizing the drive shaft by a spider bearing comprising a plurality of vanes, wherein the spider bearing is concentric with the drive shaft, the spider bearing is located within the fluid reservoir, and the spider bearing provides flow paths between the vanes.

16. The method of claim 13, further comprising stabilizing the drive shaft by a spider bearing comprising four vanes, wherein the spider bearing is concentric with the drive shaft, the spider bearing is located within the fluid reservoir, and the spider bearing provides flow paths between the vanes.

17. The method of claim 13, further comprising stabilizing the drive shaft by a spider bearing comprising five vanes, wherein the spider bearing is concentric with the drive shaft, the spider bearing is located within the fluid reservoir, and the spider bearing provides flow paths between the vanes.

18. A method of assembling an electric submersible pump (ESP) assembly at a wellbore location, comprising:

coupling a downstream end of an electric motor to an upstream end of a seal unit;

lowering the electric motor, and seal unit partially into the wellbore;

coupling a downstream end of the seal unit to an upstream end of a gas separator assembly, wherein the gas separator assembly comprises a drive shaft, a fluid reservoir concentrically disposed around the drive shaft, wherein an inside surface of the fluid reservoir and an outside surface of the drive shaft define a first annulus within a portion of the fluid reservoir that does not enclose a radial support of the drive shaft, wherein when the separator drive shaft is about 0.6875 inches in diameter, the first annulus has a volume of at least 70 cubic inches and less than 100 cubic inches; wherein when the separator drive shaft is about 0.875 inches in diameter, the first annulus has a volume of at least 85 cubic inches and less than 120 cubic inches; wherein when the separator drive shaft is about 1.0 inches in diameter, the first annulus has a volume of at least 180 cubic inches and less than 250 cubic inches; and wherein when the separator drive shaft is about 1.1875 inches in diameter, the first annulus has a volume of at least 220 cubic inches and less than 300 cubic inches;

a first fluid mover having a fluid inlet and a fluid outlet, wherein the first fluid mover is located downstream of the fluid reservoir, and wherein the fluid inlet of the first fluid mover is fluidically coupled to the first annulus;

a separation chamber concentrically disposed around the drive shaft and located downstream of the first fluid mover, wherein an inside surface of the separation chamber and the outside surface of the drive shaft define a second annulus that is fluidically coupled to the fluid outlet of the first fluid mover; and a crossover defining a gas flow path and liquid flow path separator having a gas phase discharge port open to an exterior of the assembly and a liquid phase discharge port, wherein the gas flow path and liquid flow path separator has a fluid inlet that is fluidically coupled to the second annulus;

lowering the electric motor, seal unit, and gas separator assembly partially into the wellbore;

coupling a downstream end of the gas separator assembly to an upstream end of a centrifugal pump assembly; and lowering the electric motor, seal unit, gas separator assembly, and centrifugal pump assembly partially into the wellbore.

19. The method of claim 18, wherein the gas separator assembly comprises:

a second fluid reservoir concentrically disposed around the drive shaft and located downstream of the first fluid mover, wherein an inside surface of the second fluid reservoir and an outside surface of the drive shaft define a third annulus that is fluidically coupled to the fluid outlet of the first fluid mover; and a second fluid mover having a fluid inlet and a fluid outlet, wherein the second fluid mover is located downstream of the second fluid reservoir, and wherein the fluid inlet of the second fluid mover is fluidically coupled to the second fluid reservoir, wherein the crossover is located downstream of the second fluid mover, wherein the fluid inlet of the crossover is fluidically coupled to the fluid outlet of the second fluid mover, and wherein the fluid inlet of the crossover is fluidically coupled to the fluid outlet of the first fluid mover via the second fluid mover and via the second fluid reservoir.

20. The method of claim 19, wherein the gas separator assembly further comprises a spider bearing concentric with the drive shaft and located within the first fluid reservoir, wherein the spider bearing comprises four vanes or five vanes, and further comprising stabilizing the drive shaft by the spider bearing.

* * * * *